US010415234B2

(12) United States Patent
Riggs et al.

(10) Patent No.: US 10,415,234 B2
(45) Date of Patent: Sep. 17, 2019

(54) METHOD AND APPARATUS FOR INTERCEPTING WATER IN A CAVITY WALL

(71) Applicant: Carbon Cut Holdings Limited, Dorset (GB)

(72) Inventors: Christopher John Riggs, Dorset (GB); Steven Caffall Finch, London (GB)

( * ) Notice: Subject to any disclaimer, the term of this patent is extended or adjusted under 35 U.S.C. 154(b) by 22 days.

(21) Appl. No.: 15/555,726

(22) PCT Filed: Mar. 4, 2016

(86) PCT No.: PCT/GB2016/050592
§ 371 (c)(1),
(2) Date: Sep. 5, 2017

(87) PCT Pub. No.: WO2016/142667
PCT Pub. Date: Sep. 15, 2016

(65) Prior Publication Data

US 2018/0058064 A1 Mar. 1, 2018

(30) Foreign Application Priority Data

Mar. 6, 2015 (GB) ..... 1503881.3
Mar. 28, 2015 (GB) ..... 1505368.9

(51) Int. Cl.
*E04B 1/70* (2006.01)

(52) U.S. Cl.
CPC ..... *E04B 1/7038* (2013.01)

(58) Field of Classification Search
CPC ..... E04B 1/7038; E04B 1/70; E04B 1/7046
(Continued)

(56) References Cited

U.S. PATENT DOCUMENTS 3,942,292 A * 3/1976 Robinson ..... E04B 1/7046 52/204.2
4,282,691 A * 8/1981 Risdon ..... E04B 1/644 52/101

(Continued)

FOREIGN PATENT DOCUMENTS

EP 3075913 A1 * 10/2016 ..... E02D 31/100
GB 1349766 A * 4/1974 ..... E04B 1/7046

(Continued)

OTHER PUBLICATIONS

International Search Report and Written Opinion for PCT/GB2016/050592 dated Aug. 9, 2016, 21 pages.

*Primary Examiner* — Christine T Cajilig
(74) *Attorney, Agent, or Firm* — Fay Sharpe LLP

(57) ABSTRACT

A flexible, elongate barrier comprising relatively rigid barrier portions connected by elastomeric joints is introduced slidingly into the cavity of a cavity wall and sealed to the outer leaf of the wall by introducing a portion of the barrier into a slot cut in the inner surface of the wall and/or by providing a water resistant composition which may be injected into the slot. The barrier may form an X or V shaped configuration defining a channel from which water is discharged via drains from the cavity. The barrier portions may be arranged in a flat configuration when the barrier is stored on a reel and moved through a deployed configuration to an installation configuration against the resilient bias of the joint so that they spring out to the deployed configuration to conform to the width of the cavity after installation.

11 Claims, 21 Drawing Sheets

(58) Field of Classification Search
USPC ..... 52/302.1
See application file for complete search history.

(56) References Cited

U.S. PATENT DOCUMENTS

| | | | | | |
|---|---|---|---|---|---|
| 6,105,323 | A * | 8/2000 | Paulle | E04B 1/70 | 52/302.1 |
| 6,883,284 | B1 * | 4/2005 | Burgunder | E04F 17/00 | 52/169.5 |
| 7,730,685 | B1 * | 6/2010 | Keene | E04B 1/7046 | 52/169.5 |
| 9,309,665 | B2 * | 4/2016 | Riggs | E04F 13/08 | |
| 2007/0107333 | A1 * | 5/2007 | Marsh | E02D 29/025 | 52/223.7 |

FOREIGN PATENT DOCUMENTS

| | | | | |
|---|---|---|---|---|
| GB | 2445223 | A * | 7/2008 | E04B 1/644 |
| WO | 2012042193 | A2 | 4/2012 | |

* cited by examiner

METHOD AND APPARATUS FOR INTERCEPTING WATER IN A CAVITY WALL

This invention relates to methods of intercepting water flowing down through the cavity of a cavity wall, particularly to prevent the water from travelling to the inner leaf of the wall via insulation installed in the cavity.

Cavity walls comprise two generally vertical leaves separated by a narrow cavity. In this specification a leaf means any structure defining one of the two opposed wall surfaces of the cavity. The cavity may be vertically continuous (extending for most or all of the full height of the building) or discontinuous (such as where a reinforced concrete floor slab extends between the inner and outer leaves). The inner and outer leaves can be made of the same or different materials, for example, bricks for the outer leaf and bricks, blocks or concrete for the inner leaf. Usually however at least the outer leaf is built from bricks or blocks separated by continuous horizontal mortar joints and staggered vertical mortar joints.

Traditionally the cavity was left empty, but it is common now to retro-fill the cavity with an insulating material to reduce heat loss through the wall. Many such cavities have been filled with expanding foam insulation, but it is now more common to introduce an inert material such as mineral wool or beads of expanded polystyrene by blowing it via a nozzle through holes drilled in the outer leaf of the wall.

It is common for water to penetrate into the cavity, either through the outer leaf or through small gaps in the structure, and then to run down the internal surface of the outer leaf inside the cavity. This poses a problem when installing insulation in the cavity because water contacting the insulation will gradually travel across the cavity through the insulation. It is found that the water may be able to bridge the cavity to reach the inner leaf of the wall, causing dampness within the habitable rooms of the building, if it is allowed to travel vertically downwards through the cavity for more than about 8 m-12 m from its point of ingress. For this reason it is desirable in a cavity which extends for more than this height to install barriers every few meters so as to intercept the water travelling down inside the cavity before it has traveled far enough to bridge the insulation. The cavity is thus divided into vertically stacked portions so that insulation can be introduced into each portion to rest on the barrier.

Conventionally this has been accomplished by removing bricks from the outer leaf of the wall and removing bricks or mortar from an opposite point on the inner leaf of the wall, inserting a long sheet of flexible barrier material on a roll into the wall at that point, and replacing the bricks and mortar to incorporate opposite edges of a short portion of the barrier sheet into the two leaves of the wall to form a tray. The roll of barrier material is moved progressively along the wall by removing and replacing bricks until the whole length of the wall has been removed and replaced with the tray installed along the whole length of the cavity. However, this method is time consuming and expensive.

WO 2009/016338 teaches an elongate fitting for insertion into the cavity of a cavity wall, having an X shaped cross section defining a deflector means and a plurality of drain holes. It may comprise two plates which are secured together by welding. Water flowing down through the cavity passes through the drain holes to the deflector means which diverts the water to the outer wall of the cavity, where it is either absorbed into the wall or runs down its surface.

The fitting is dimensioned to fit tightly into the cavity and is installed by sliding into the cavity from one end. Metal pins or shafts are arranged to extend across the cavity below the fitting and mounted in the mortar at each end to support the fitting which rests on them in the cavity.

WO2012/042193 teaches an elongate fitting with an X shaped cross-section for insertion into the cavity of a cavity wall. The fitting is supplied on a reel with the cross-section flattened and springs into its cruciform shape as it straightens on insertion into the cavity. The lower two limbs of the fitting are formed with holes to allow insulation material in the cavity below the fitting to pass into the spaces between the upper and lower limbs. The upper two limbs define a V-shaped channel to collect water and channel it to the end of the fitting and away from the cavity.

In practice it is found that a proportion of the water flowing down the inner surface of the cavity may flow past such a barrier.

NL 1033560C discloses a cavity wall barrier comprising co-extruded hard plastics portions connected together by soft plastics joint portions.

It is a general object of the present invention to provide an improved method and apparatus for intercepting water in a cavity wall.

In some aspects, the invention sets out more particularly to provide more effective sealing of a barrier to the outer leaf of the wall so that more of the water is intercepted by the barrier; and/or to make it easier to install the barrier in the cavity.

Accordingly in its various aspects the present invention provides a method, a system, and a barrier as defined in the claims.

Further features and advantages will be apparent from the various illustrative embodiments which will now be described, purely by way of example and without limitation to the scope of the claims, and with reference to the accompanying drawings, in which:

FIGS. 23A-23E are further views of parts of the cutting tool of FIG. 22, wherein FIG. 23E is a section at E-E of FIG. 23D;

Figure 1:
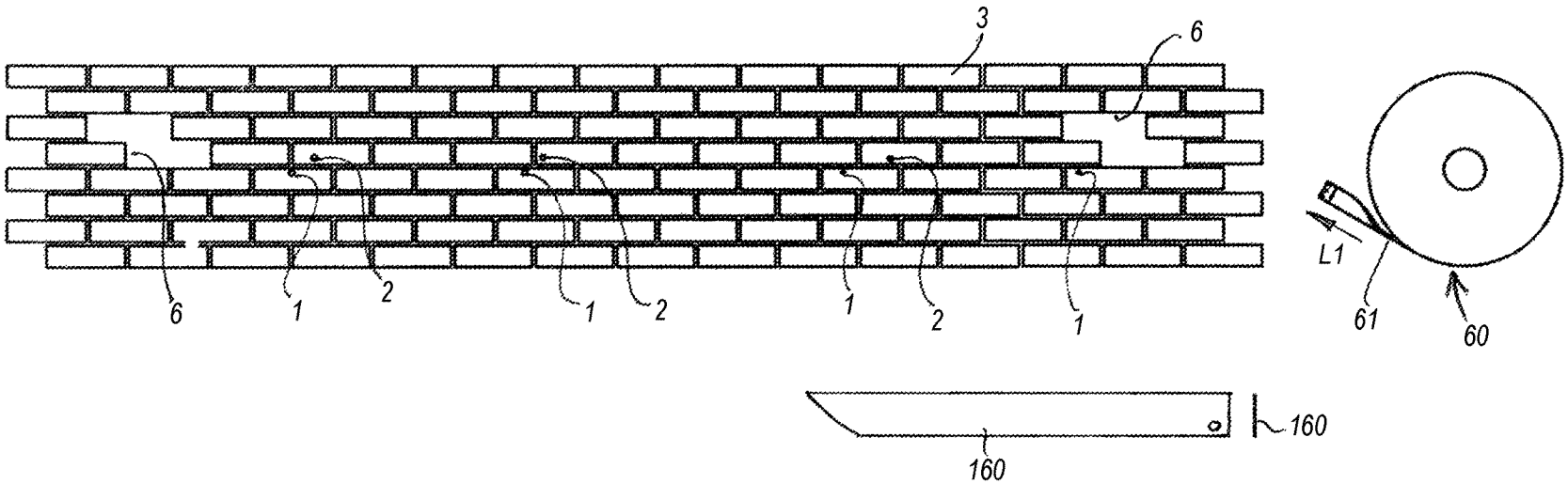
FIG. 1 shows a wall with apertures ready to receive guides for the installation of an elongate flexible barrier from a reel.

Reference numerals which appear in more than one figure indicate the same or corresponding features in each of them.

Referring to the figures, it can be seen that in one aspect, various embodiments provide a method of installing a barrier to intercept water travelling through a cavity between opposed wall surfaces of two leaves of a cavity wall; comprising: providing an elongate barrier 10, 110, 210, 310, 311, 312, 313, 314, 315, the barrier including an interception surface 11 which extends along a length dimension of the barrier; slidingly inserting the barrier into the cavity in a direction along the length dimension of the barrier; and supporting the barrier in the cavity in a deployed position wherein the interception surface 11 is arranged to intercept the water travelling through the cavity. The method includes introducing a cutting tool 20, 21 into the cavity; operating the cutting tool to cut an elongate slot 22 in one of the wall surfaces; and introducing an insertion portion of the barrier into the slot.

In another aspect, various embodiments provide a system for intercepting water travelling through a cavity between opposed wall surfaces of two leaves of a cavity wall, comprising: an elongate barrier, the barrier including an interception surface 11 and an insertion portion, the interception surface and the insertion portion extending along a length dimension of the barrier; and a cutting tool 20, 21, the cutting tool being moveable through the cavity and operable to cut an elongate slot 22 in one of the wall surfaces. The insertion portion of the barrier is configured to be received in the slot 22 in a deployed position of the barrier wherein the interception surface is arranged to intercept the water travelling through the cavity.

In another aspect, various embodiments provide an elongate flexible barrier for intercepting water travelling through a cavity between opposed wall surfaces of two leaves of a cavity wall; the barrier including at least first and second elongate barrier portions 50, 51; the barrier portions being connected together along a length dimension of the barrier and moveable relative to one another to define a flattened configuration and an extended, deployed configuration, wherein in the deployed configuration the barrier defines an interception surface 11 for intercepting water travelling through the cavity. The first and second barrier portions 50, 51 are connected together by an elastomeric joint or hinge 80, the barrier portions being less elastic than the joint, the joint extending along the length dimension of the barrier.

In another aspect, various embodiments provide an elongate barrier for intercepting water travelling through a cavity between opposed wall surfaces of two leaves of a cavity wall; the barrier including at least first and second elongate barrier portions 50, 51; the barrier portions being connected together along a length dimension of the barrier to define at least an extended, deployed configuration. In the deployed configuration the barrier defines an interception surface 11 for intercepting water travelling through the cavity. At least one elastomeric fin 90 is provided, the barrier portions being less elastic than the fin, the fin being connected to a respective one of the barrier portions and extending along the length dimension L1 of the barrier to define an outwardly extending extremity of the barrier.

Figure 6:
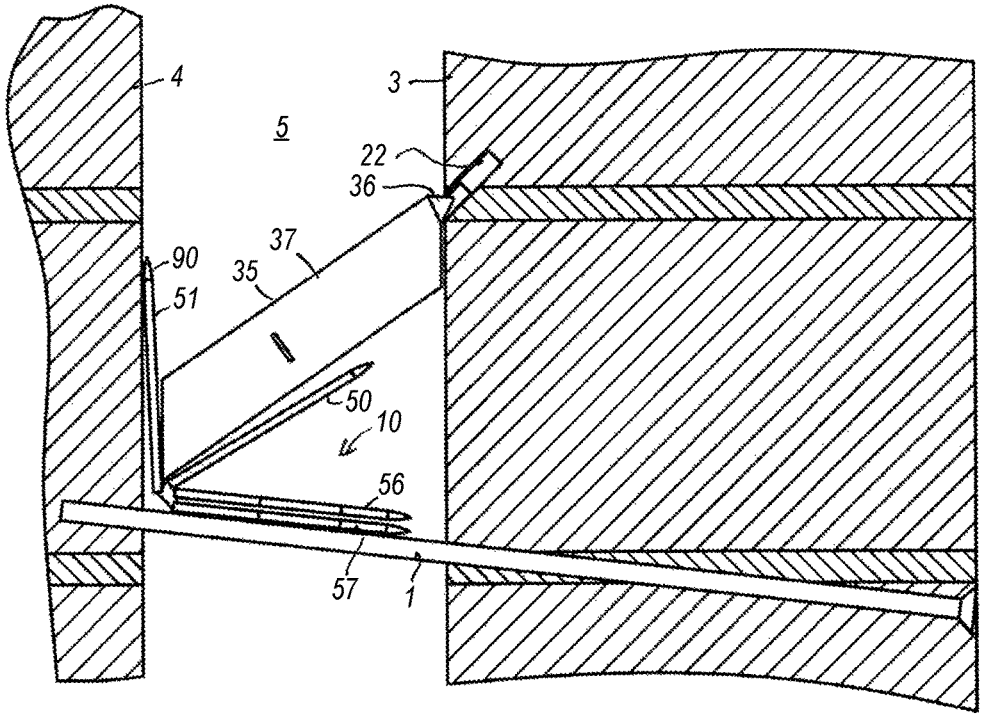
FIG. 6 shows a dispensing tool slidingly supported on the first barrier in an installation configuration of the first barrier with the cavity of a cavity wall.
Figure 7:
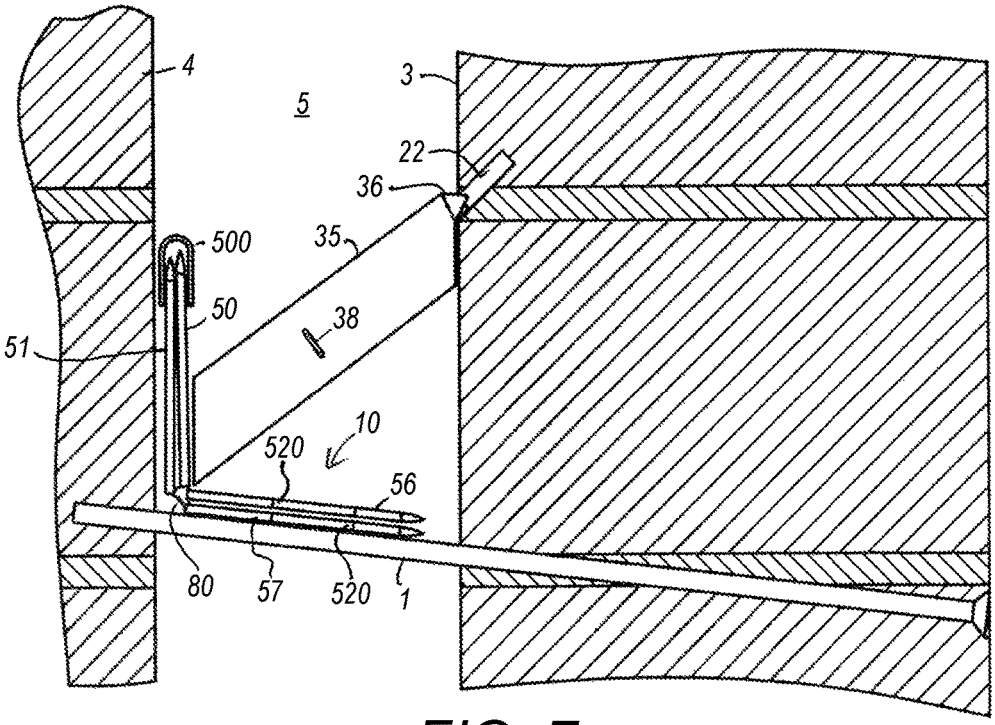
FIG. 7 shows the dispensing tool slidingly supported on the first barrier in an alternative installation configuration wherein the upper barrier portions are retained in the installation configuration by a clip.

In another aspect, various embodiments provide a method of installing a barrier to intercept water travelling through a cavity between opposed wall surfaces of two leaves of a cavity wall; comprising: providing an elongate flexible barrier including at least first and second elongate barrier portions and an interception surface; the barrier portions being connected together along a length dimension of the barrier and moveable relative to one another to define a flattened, storage configuration and an extended, deployed configuration; rolling the barrier in the storage configuration to form a coil 61 (which may be stowed on a reel 60, FIG. 1); and then unrolling the barrier from the coil and slidingly inserting the barrier into the cavity in a direction along the length dimension of the barrier; and then supporting the barrier in the cavity in the deployed configuration of the barrier portions and in a deployed position wherein the interception surface is arranged to intercept water travelling through the cavity. The barrier portions are moveable relative to one another to define an installation configuration (FIG. 2A, FIG. 6, FIG. 7). The barrier portions are resiliently biased away from the installation configuration towards the deployed configuration. During installation of the barrier, the barrier portions are moved from the storage configuration to the installation configuration. A releasable restraint means (such as a clip 500) is arranged to restrain the barrier portions in the installation configuration, and the restraint means is released to permit the barrier portions to move from the installation configuration to the deployed configuration.

The restraint means may be released after inserting substantially the full length of the barrier into the cavity, which advantageously allows the insertion portion of the barrier to enter into a slot in the outer leaf of the wall by moving the insertion portion through a small distance transverse to the length dimension of the barrier.

In another aspect, various embodiments provide a method of installing a barrier to intercept water travelling through a cavity between opposed wall surfaces of two leaves of a cavity wall; comprising: providing an elongate flexible barrier including at least first and second elongate barrier portions and an interception surface; the barrier portions being connected together along a length dimension of the barrier and moveable relative to one another to define a flattened, storage configuration and an extended, deployed configuration; rolling the barrier in the storage configuration to form a coil; and then unrolling the barrier from the coil and slidingly inserting the barrier into the cavity in a direction along the length dimension of the barrier; and then supporting the barrier in the cavity in the deployed configuration of the barrier portions and in a deployed position wherein the interception surface is arranged to intercept water travelling through the cavity. The barrier portions are moveable relative to one another to define an installation configuration, and during installation of the barrier, the barrier portions are moved from the storage configuration through the deployed configuration to the installation configuration, and then moved from the installation configuration back to the deployed configuration.

This means that the interception surface can be biased towards the wall surface so that water does not escape (or proportionately less water escapes) between wall and barrier.

In another aspect, various embodiments provide a method of installing a barrier to intercept water travelling through a cavity between opposed wall surfaces of two leaves of a cavity wall; comprising: providing an elongate barrier, the barrier including an interception surface which extends along a length dimension of the barrier; slidingly inserting the barrier into the cavity in a direction along the length dimension of the barrier; and supporting the barrier in the cavity in a deployed position wherein the interception surface is arranged to intercept the water travelling through the cavity. A water resistant composition is arranged between the interception surface and a respective one of the leaves of the cavity wall to divert water flowing along said one of the leaves onto the interception surface 11.

Figure 29A:
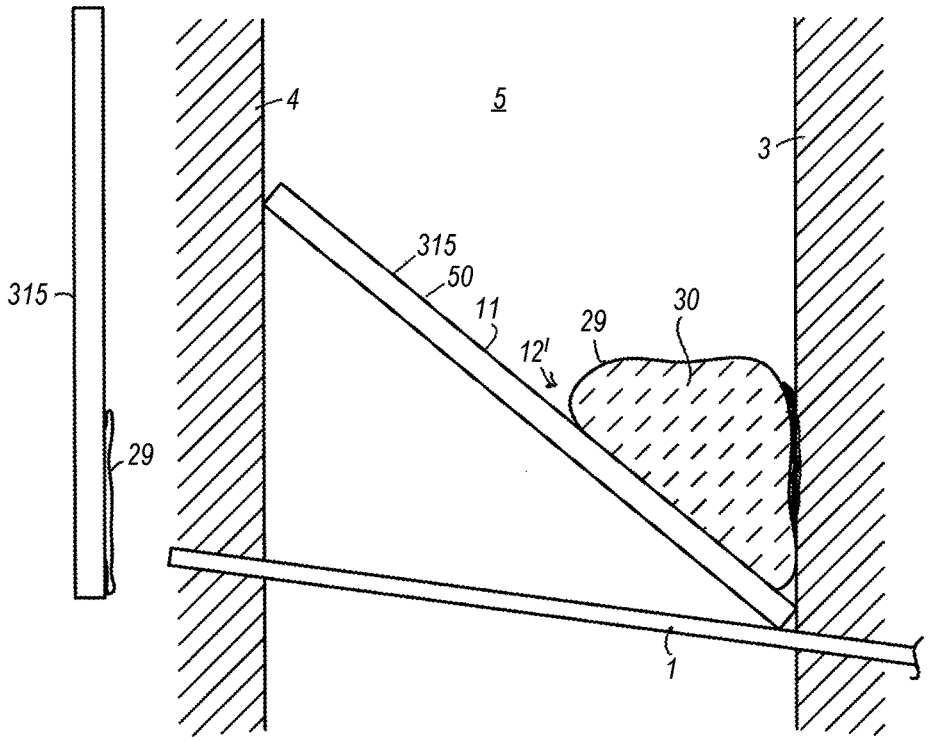
FIG. 29A shows a barrier comprising a single flat strip and a conduit into which a water resistant composition is injected, both before and after installation in a cavity.
Figure 29B:
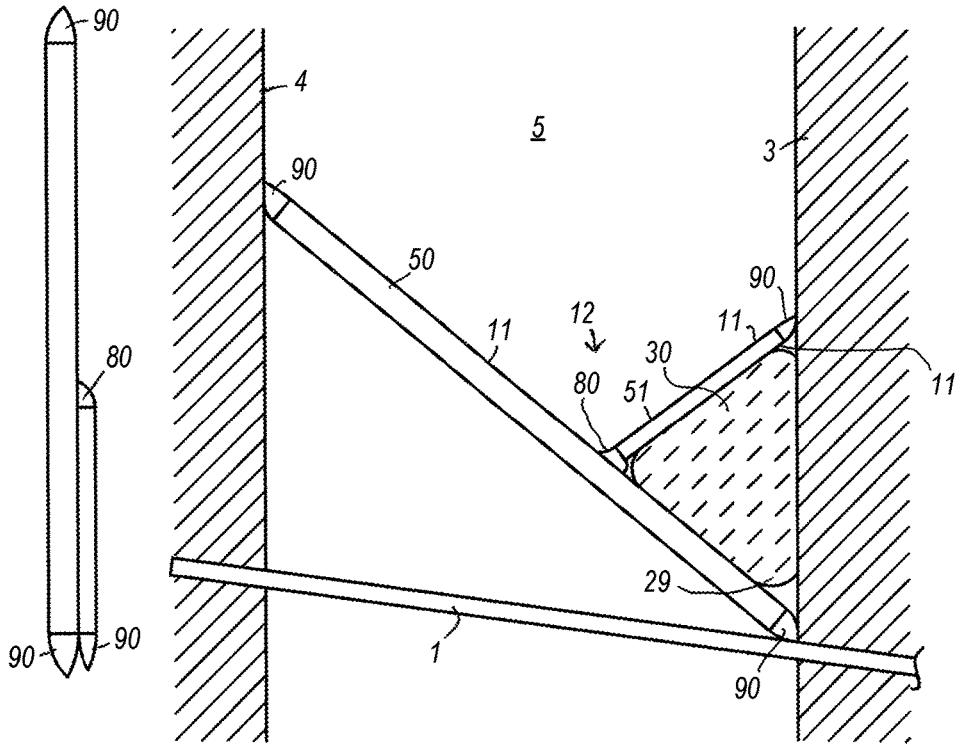
FIG. 29B shows a second barrier comprising two rigid portions joined by an elastomeric hinge and a conduit into which a water resistant composition is injected, both before and after installation in a cavity.

The composition can be injected into a slot or applied to one of the barrier portions e.g. as a tape covered by a protective film which is removed after installation of the barrier, or a film that is perforated so that the composition seeps out through the perforations, or activated by heating by an electric wire or other means extending along it, or arranged in a tube and extruded by air pressure in another tube, or applied by a dispensing tool moving along the cavity, either pumped along a tube or dispensed from a cartride on the tool, or injected into a conduit of the barrier as shown for example in FIGS. 29A and 29B, showing a flexible plastics conduit which carries the composition 30 (e.g. a resin, which may be activated by water or heat) along the barrier inside the cavity. The conduit may be perforated or may dissolve when it contacts water to release the resin which over time forms a seal against the cavity wall.

In another aspect, various embodiments provide a method of installing a barrier to intercept water travelling through a cavity between opposed wall surfaces of two leaves of a cavity wall; comprising: providing an elongate flexible barrier including at least first and second elongate barrier portions and an interception surface; the barrier portions being connected together along a length dimension of the barrier and moveable relative to one another to define a flattened, storage configuration and an extended, deployed configuration; rolling the barrier in the storage configuration to form a coil; and then unrolling the barrier from the coil and slidingly inserting the barrier into the cavity in a direction along the length dimension of the barrier; and then supporting the barrier in the cavity in the deployed configuration of the barrier portions and in a deployed position wherein the interception surface defines a channel to intercept water travelling through the cavity and convey the intercepted water along the barrier. A plurality of drains are arranged at spaced locations along the length dimension of the barrier between opposite ends of the barrier, each drain being fluidly connected to the channel in the deployed position of the barrier, the drains extending outwardly through one of the leaves of the wall to convey water intercepted by the interception surface out of the cavity.

Advantageously, the abovementioned aspects can be combined as further described below.

By arranging an insertion portion of the barrier in a slot in the outer leaf of the wall, or arranging a water resistant composition to seal the barrier to the outer leaf of the wall, preferably by introducing the water resistant composition into a slot in the wall so as to seal an insertion portion of the barrier in the slot, the proportion of water intercepted by the barrier is advantageously increased. Where a slot is provided, the insertion portion of the barrier can be slidingly inserted into the slot as the barrier is slidingly inserted into the cavity through a hole in the wall. Alternatively, the barrier can be slidingly inserted into the cavity through a hole in the wall in an installation configuration, and then the barrier portions can be moved from the installation configuration to a deployed configuration in which the insertion portion enters into the slot (optionally, after filling the slot with the composition) by a small movement in a direction transverse to the length dimension of the barrier. Since in the latter case the insertion portion does not slide along the slot, in this case a relatively viscous flowable composition can be used to seal the insertion portion in the slot.

The barrier is preferably sufficiently flexible along its length dimension to conform to the mean surface plane defined by inwardly facing surface of the outer leaf of the wall, which may vary gradually and slightly if at all over the length and height of the wall from a perfectly flat plane, and also to bend around a sufficiently large radius to be rolled into a coil in the storage configuration. However, the barrier is preferably stiff enough to allow it to be inserted slidingly along its length dimension, i.e. in the direction of its axial length, into the cavity without buckling, preferably including at least to some degree by pushing it into the cavity as well as pulling it through the cavity, and to remain nearly horizontal when installed in the cavity. Preferably it is sufficiently stiff to depart by not more than 1 degree from horizontal, more preferably not more than 0.5 degree from horizontal under its own weight if supported in the deployed configuration on pins 1 spaced 1 m apart. This is accomplished by arranging the relatively stiff barrier portions as flat, elongate, plates, preferably of plastics material, so that they are stiff in their width direction but flexible for movement in their thickness direction.

For this reason, in the deployed configuration the length axis of the barrier will be straight or only very gradually curved, and so, particularly where the barrier is arranged to sealingly engage the outer leaf so as to divert water running down the outer leaf onto the interception surface, local discontinuities between adjacent bricks are more significant than the overall straightness of the wall along its length.

In practice, variations in the surface level of adjacent bricks from the mean plane of the wall surface (defined at any point by the mean surface of the bricks forming that region of the wall) are seldom more than about 1 mm on the outer face and 2 mm on the inner face of the outer leaf.

Surprisingly however, the applicant has observed that within the cavity of a building some decades after construction, the inwardly facing surfaces of the bricks forming the outer leaf are usually found to be in perfect condition while the inwardly facing surface of the vertical mortar joints between them is deeply eroded by water running down within the cavity. This is not true however of the inwardly facing surface of the horizontal mortar joint between the same bricks, which is typically eroded to a much lesser extent or in perfect condition. On the vertical mortar joints it is observed that the depth of erosion is much greater towards the centre of the bricks than at their corners where it meets the horizontal joints. In a wall which is thus eroded, the horizontal mortar joints therefore represent the only continuous horizontal region in which the inwardly facing surface of the outer leaf can be expected to lie within a few millimeters of the mean plane of the wall surface.

For this reason, in order to ensure a continuous sealing engagement between the interception surface and the inner surface of the outer leaf, the seal obtained by use of a water resistant composition and/or the slot is preferably formed in one of the horizontal mortar joints. The slot may extend downwardly or upwardly through the mortar joint into the adjacent brick. This is particularly advantageous where the insertion portion forms a key to retain the barrier by mechanical abutment against the slot against removal in any direction other than along the length dimension of the barrier.

More reliable sealing to the outer leaf is also obtained by cleaning projections from the inwardly facing surface of the outer leaf, and by providing a flexible elastomeric tip which is conformable (by bending through a much shorter radius than the relatively stiff barrier portion to which it is attached) to the contours of the wall surface.

The cutting tool can be arranged to follow the horizontal mortar joint, for example by an, optical or other sensor arrangement which controls a mechanical actuator to angularly adjust the direction of movement of the tool through a small range of movement relative to a horizontal plane according to variations in e.g. the colour, texture, or other characteristic parameter of the sensed wall surface which indicate a departure from the target mortar joint. Additionally or alternatively the direction of travel can be adjusted by remote control (e.g. electrically via a flexible wire or wireless link) by an operator observing the image from the camera which shows the target mortar joint.

A particular problem which arises on a long wall when installing the barrier along a horizontal mortar joint is that the mortar joint is typically not perfectly horizontal, but in fact is a catenary curve which follows the line of the string which was used as a horizontal reference line during construction of the wall. For this reason the joint will typically fall towards the centre of the wall, and the barrier is sufficiently flexible to follow this curve.

On a long wall this can mean than the intercepted water can pool in the channel at the centre of the barrier and may even overflow the channel without reaching a drain at either end of the barrier.

In order to solve this problem, and also to carry excessive volumes of water from a wall which is exposed to high rainfall, preferably a plurality of drains 2 are fluidly connected to the channel of the barrier at spaced positions along its length, so that the water is drained from the whole length of the barrier even on a long wall.

Referring to FIG. 1, in order to install the barrier in a cavity 5 between an outer leaf 3 and inner leaf 4 of a cavity wall, the intended installation position of the barrier is first determined by identifying a horizontal mortar joint between the bricks or blocks of the wall along which there are no cavity wall ties to obstruct the insertion of the barrier. This can be done e.g. by visual inspection via a hole 6 in the wall, optionally using an endoscope, or by detecting the presence of the cavity wall ties by means of a suitable metal detector or the like.

A plurality of support elements or pins 1 may be arranged in spaced relation along a length of the cavity so that each support element extends into the cavity to support the barrier within the cavity. A short piece of the barrier may be placed in the cavity to determine the correct vertical position of the support elements in relation to the mortar joint in which slot is to be formed. The support elements 1 may be spaced apart for example by a distance of about 1 m, for example, every 900 mm. Each support element may be a threaded fastener engaged in a plastics sleeve, the fastener optionally having two threaded regions spaced apart along its length to expand the sleeve at two spaced locations respectively within the outer and inner leaves, as known in the art. Each fastener 1 can be installed by inserting it through a drilled hole slightly upwardly through the outer leaf and into the inner leaf. Optionally at this time, holes can be drilled in the outer leaf, or alternatively bricks can be removed from the outer leaf to form spaced holes, so that drains 2 can be inserted into the holes between the ends of the barrier after the barrier has been installed. Optionally, multiple drains may be inserted, for example, at approximately 3 m or 5 m intervals. Conveniently, holes may also be drilled for the injection of insulation above or below the barrier.

One or two bricks are removed to form a hole 6 in the outer leaf 3 of the wall at one or both ends of the cavity, as shown in FIG. 1, or alternatively from an end wall of the building (not shown) which extends away from an external corner if that is the preferred point of entry; thus the barrier can be inserted in a straight line lengthwise into the cavity through the end wall, or alternatively as shown, by bending it sinuously as it passes via the hole 6 through the thickness of the outer leaf. If the barrier is to be inserted from inside the building then a hole is made instead in the inner leaf.

Referring also to FIGS. 24, 25, and 28A-28C, first and second guides 62, 63 may be provided, each guide having a body and a deflection surface 64 which extends into the cavity when the body of the guide is fixed in the hole by screw attachments as shown. Rollers 67 are also provided to assist the barrier and pull rope to move into and through the cavity. The second guide may include a winch 65. The guide is inserted into the aperture in the outer leaf of the wall (or, if the barrier is to be installed from within the building, in the inner leaf) as shown.

An installation shoe 160 (shown in side and end view in FIG. 1), comprising an elongate flexible plate with its lower edge being forwardly and upwardly inclined at its leading end to guide it over the spaced pins 1, may then be connected to a series of flexible rods (drain rods are suitable) and inserted through the hole 6 into the cavity and pushed through the cavity while slidingly supported by the pins 1 until it appears at the other hole 6 at the far end of the cavity. A pull rope 66 can then be attached to the plate or rods and pulled back through the cavity.

Once the pull rope 66 extends between both holes, it can be used to pull a cutting tool 21 through the cavity which is operated to cut a slot 22 along the target mortar joint just above the support elements 1.

The cutting tool 21 includes an elongate skid or skids 600, each of which comprises a pair of thin plates that are flexible enough to bend sinuously out of their thickness plane as the tool is introduced through the hole 6 into the cavity, but relatively rigid so as to resist bending in that plane. The or each skid is slidably supported on the support pins 1 as the tool moves along the cavity. The body of the cutting tool comprises a pair of plates 601 which have straight leading edges which serve to remove projections such as mortar extruded from the joints in the brickwork from at least the surface of the outer leaf, preferably from both wall surfaces. The mortar is typically weak and so is knocked off the wall by the leading edges which slide along the wall surfaces as the tool is pulled through the cavity on the pull rope. The plates are biased apart in parallel relation by an articulated mechanism 602 and spring 603. An abrasive disc 604 driven by a pneumatic motor 605 extends from an aperture in one of the plates at an angle relative to the plane of said plate, which is aligned in use with the inner surface of outer leaf 4. The angle can be adjusted to suit the width of the cavity (hence the installed angle of the insertion portion 52 of the barrier, corresponding to the angle of the slot 22) by rotating the motor and securing it at the required orientation with screws 606. The motor is driven by compressed air via hose 607 so that after introducing the tool into the cavity and starting the motor in rotation, the tool is drawn through the cavity using the pull rope 66 with the plates 601 sliding along the wall surfaces, and the disc cuts a slot to the required depth and at the required angle. The support pins are arranged in relation to the horizontal target mortar joint so that the slot is cut along that joint, as shown e.g. in FIG. 6. Of course, the motor could be electric if preferred, but the air discharged from a pneumatic motor advantageously can be used to blow debris out of the slot.

After cutting the slot 22, or if no slot is required (for example, in a geographic area in which low rain penetration is normal), the pull rope can be attached at one end to the distal end of the barrier 10 which is coiled on the reel 60, and at the other end to the winch (or simply pulled through the cavity by hand).

Figure 2:
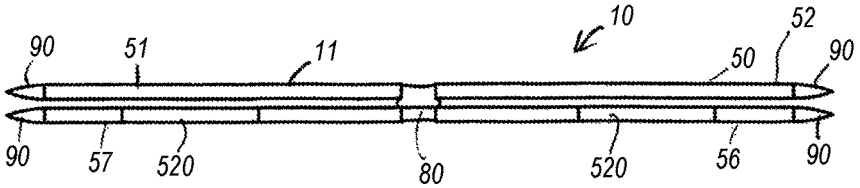
FIG. 2 shows a first elongate flexible barrier in end view.
Figure 2A:
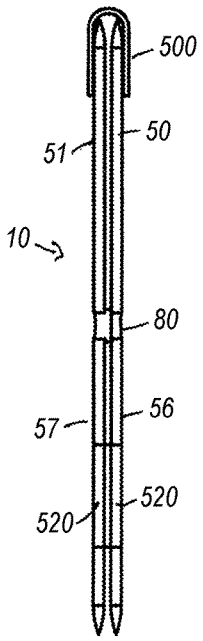
FIG. 2A shows the first barrier in an installation configuration as it travels via a hole in the outer leaf of the wall into the cavity.
Figure 3:
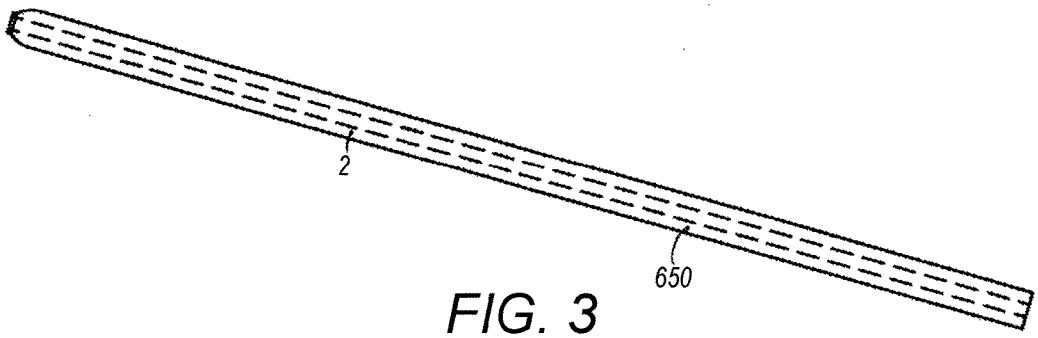
FIG. 3 shows a drain.
Figure 4:
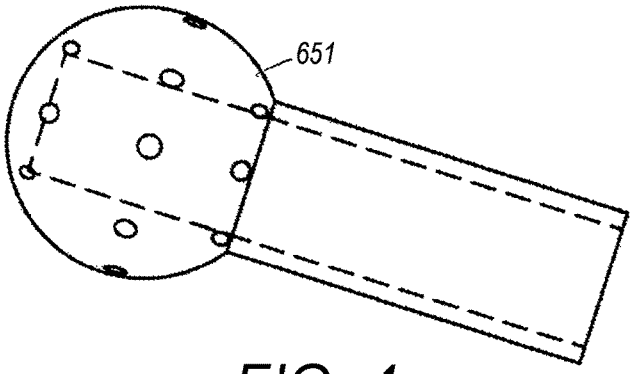
FIG. 4 shows a filter for securing the drain to an elongate portion of the first barrier.

The first barrier 10 of FIG. 2 and FIGS. 5A, 5B and 5C includes first and second elongate upper barrier portions 50, 51 and third and fourth elongate lower barrier portions 56, 57, all of which are connected together to form a cruciform ("X" shaped) cross section by an elastomeric hinge or joint 80. The barrier portions all extend outwardly from the hinge 80 when considered in cross-section, the barrier portions and hinge all extending along a length dimension L1 of the barrier and moveable relative to one another to define a flattened, storage configuration as shown in FIG. 2, an extended, deployed configuration (FIG. 9), and an installation configuration (FIG. 7).

Preferably each of the four barrier portions comprises a flat strip of unplasticised polyvinyl chloride (uPVC) or other plastics material which is relatively more rigid and inelastic that the elastomeric material of the hinge 80. The barrier may be manufactured by simultaneously extruding all of the barrier portions together with the hinge, preferably in such a position that when stress is relieved the hinge returns the barrier portions to a rest position which is close to the flattened, storage configuration of FIG. 2. The barrier is rolled to form a coil 61, preferably being stored in a suitable container or on a reel 60, so that it can be easily unrolled from the container or reel during deployment as it is slidingly inserted into the hole 6 made by removing one or two bricks from the outer leaf 3 of the wall.

Figure 16:
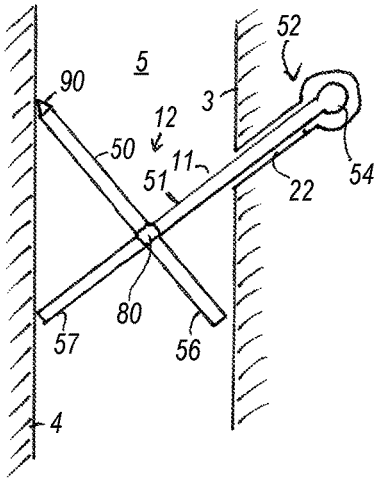
Figure 17:
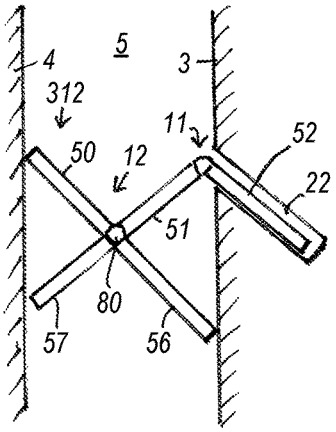
Figure 18:
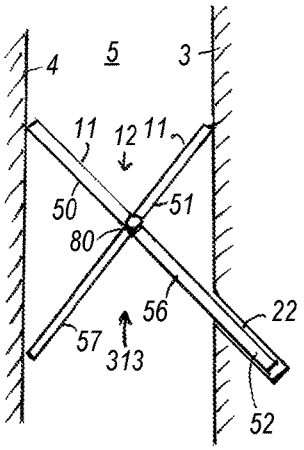

It will be noted that in this and other embodiments, the barrier comprises a number of barrier portions which are configured as flat strips having a length dimension extending along the length of the barrier, a width dimension normal to the length dimension and smaller than the length dimension, and a thickness dimension normal to the length and width dimensions and smaller than the width dimension, preferably not more than about 10% of the width dimension. The hinge or joint is arranged so that the width dimensions of the four barrier portions are all aligned in parallel or collinear relation in the storage configuration of the barrier, so that the four flat strips can be rolled together to form the barrier into a coil. Even in embodiments where the insertion portion of one of the strips is enlarged to engage in the slot 22 (e.g. as shown in FIG. 16) its maximum thickness dimension is preferably not more than about 20% of its width dimension and the strips are preferably arranged so that their width dimensions can all be aligned in parallel or collinear relation, so that the barrier can be easily rolled for storage and flexed as it passes through the wall into the cavity during installation.

Figure 5A:
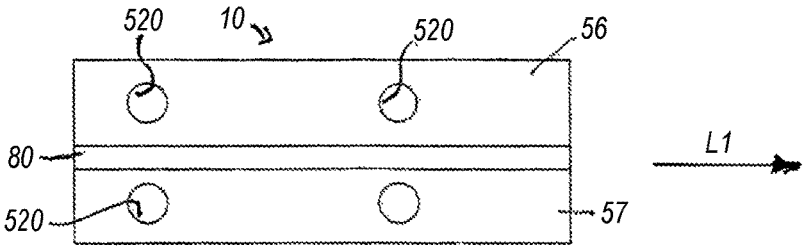
FIGS. 5A, 5B and 5C are bottom views of the first barrier in the storage configuration showing respectively three alternative variants of the discontinuities in the lower barrier portions.

The first and second barrier portions 50, 51 are continuous and imperforate so that they define an interception surface 11 which is arranged to form a channel to collect the water flowing down, particularly along the inner surface of the outer leaf 3 of the wall. The barrier includes a lower barrier portion comprising lower barrier portions 56, 57 which are discontinuous, i.e. they each have a series of discontinuities spaced apart along the length dimension of the barrier. In the example of FIG. 5A the discontinuities are holes 520 which are formed (e.g. by punching or laser cutting immediately after extrusion) in each of the lower barrier portions 56, 57.

Figure 5B:
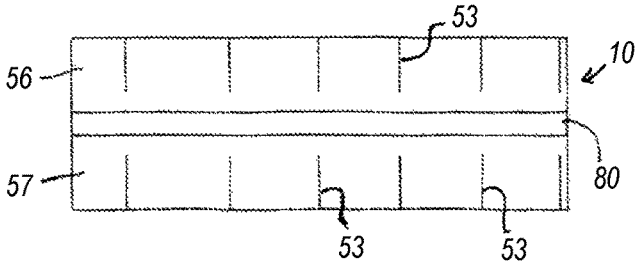
Figure 5C:
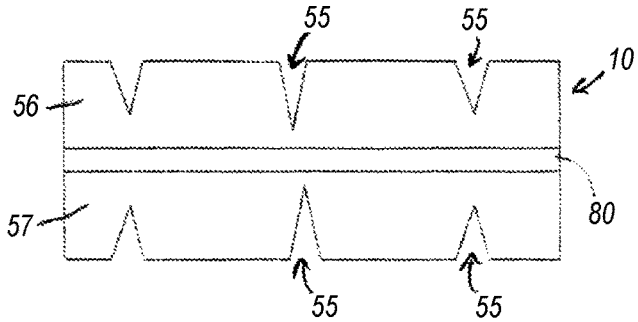

In the example of FIG. 5B the discontinuities are cuts or slits 53 which extend inwardly from the outer edges of the lower barrier portions 56, 57. In the example of FIG. 5C the discontinuities are recesses 55 extending inwardly from the outer edge of each of the lower barrier portions 56, 57. Similar discontinuities can be formed in the lower barrier portions 56, 57 of the barriers of FIGS. 15, 16, 17, 18, and 19. When the lower barrier portions are arranged below the upper barrier portions in the deployed position of the barrier, the lower barrier portions define apertures through which air or insulation material may pass from the cavity below the barrier into spaces between the upper and lower barrier portions, it being understood that if the discontinuities are recesses 55 then the apertures are bounded by the recesses and by the leaf of the wall against which they rest.

Each of the four barrier portions is provided with a respective elastomeric fin 90, the fin being connected to the respective barrier portion and extending along the length dimension of the barrier to define an outwardly extending extremity of the barrier. The fins can be extruded simultaneously with the barrier portions and hinge portions. The distal end of each of the first and second barrier portions comprising a respective fin 90 may be used as an insertion portion which is inserted into a slot 22 in the wall in use. The fin spaces the respective rigid barrier portion away from the wall surface and moves pliantly over the wall surface so that it helps the insertion portion to enter the slot 22 as the barrier is moved from the installation configuration to the deployed configuration inside the cavity. This is found particularly helpful where the deployed configuration is achieved by manipulating the barrier after inserting substantially its full length into the cavity. In addition, each of the fins helps to seal the barrier inside the cavity, even where no slot is provided. Where fins are provided on the downwardly facing lower barrier portions, they may frictionally engage the walls and so help to support the barrier in the cavity.

The first and second barrier portions 50. 51 are moveable relative to one another from the flattened storage configuration through the deployed configuration to an installation configuration. In the flattened, storage configuration (FIG. 2) the first and second barrier portions 50, 51 are juxtaposed and each first barrier portion 50, 51 is superposed on a corresponding one of the lower barrier portions 56, 57, and preferably the barrier is extruded to define a rest position close to this flattened configuration.

In this position, the discontinuities in the lower barrier portions allow the lower barrier portions to expand in the length direction to a slightly different degree than the upper barrier portions, so that when the barrier is coiled on the reel it does not buckle along its length. If the discontinuities are formed as shown in FIG. 5A or FIG. 5B so as to provide a continuous outer edge (even if interrupted by slits or cuts not extending for any significant distance in the length direction) then the outer edge can slide over the support pins 1 as the barrier is inserted. Since it is also desirable to provide apertures in the lower barrier portions, holes 520 are preferred, as shown in FIG. 5A.

As the barrier is uncoiled from the reel and before inserting the barrier 10 into the cavity, the upper barrier portions are brought together and restrained in that position by a releasable restraint means which restrains them in the installation configuration as shown in FIG. 2A and FIG. 7. The lower barrier portions are also brought together, so that as it enters the hole 6 via the first guide, the barrier is arranged as a flat strip that travels over the rollers of the guide in the installation configuration of FIG. 2A.

Figure 27:
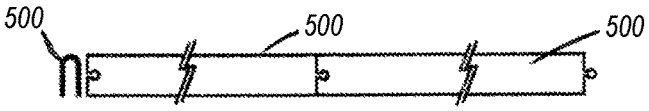
FIG. 27 shows an elongate retaining means comprising a pair of elongate clips engaged together end to end for retaining the first barrier in the installation configuration.
Figure 28A:
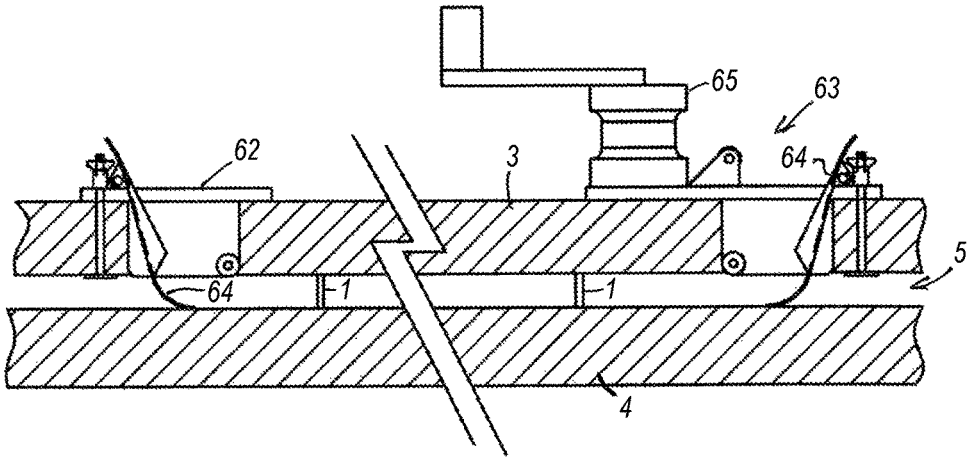
FIGS. 28A, 28B and 28C show the guides of FIGS. 24 and 25 in use in the cavity, respectively before inserting the pull rope using rods, during pulling of the pull rope, and with the first barrier pulled into the cavity and approaching the deployed position.
Figure 28B:
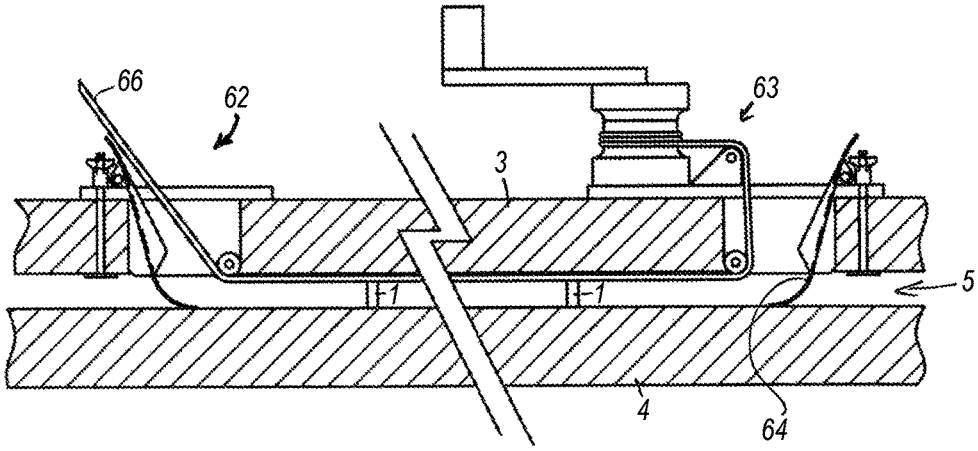
Figure 28C:
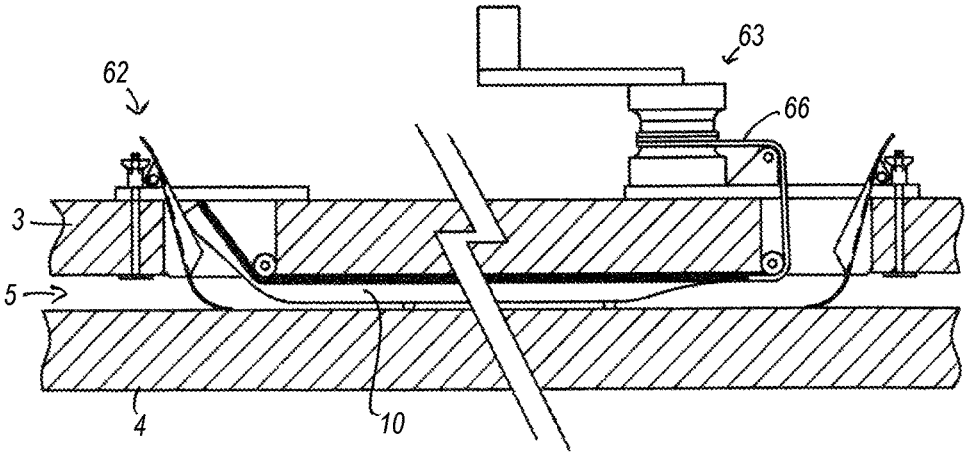

The restraint means may comprise a series of elongate clips 500 (FIG. 27) connected together end to end with cooperating interlocking portions. The clips are attached to the barrier as it is uncoiled from the reel 60 and engaged together end to end in interlocked relation as they are positioned over the adjacent edges of the first and second barrier portions in the installation position (FIG. 7). The interlocking portions keep them engaged but allow them to be separated again for re-use once the clips are released from the barrier portions. Preferably the interlocking features retain the clips together sufficiently to allow the clips to be slidingly withdrawn from the cavity after substantially the whole length of the barrier has been inserted into the cavity. In this way the restraint means is released by pulling the clips along the barrier and out of the cavity and releasing them from the barrier (FIG. 8) to permit the barrier portions to move from the installation configuration back to the deployed configuration, in which a further small movement transverse to the length direction of the barrier may bring the insertion portion 52 into the slot 22 as further described below.

The pull rope is then pulled through the cavity drawing the barrier behind it, with the upper barrier portions arranged in the installation configuration until the whole length of the barrier is inside the cavity resting on the support pins 1. The barrier is engaged against the deflection surface 64 of the first guide as it is inserted slidingly into the cavity.

Once the barrier is arranged in the cavity in the installation configuration, a cutting tool for cutting a slot and/or an injection tool for injecting a water resistant composition into the slot can be introduced into the cavity and moved along the cavity while slidingly supported on the barrier before the barrier portions are moved from the installation configuration to the deployed configuration.

In the example thus far described, a slot has already been cut by a cutting tool before introducing the barrier and so a separate injection or dispensing tool may now be used to fill the slot with the composition 30. To accomplish this, the barrier may be arranged in the installation configuration as shown in FIG. 7, wherein the lower barrier portions are laid flat on the support pins 1 and the upper barrier portions are held together by the clips 500.

By inserting the insertion portion of the barrier into the slot, water running down the wall surface tends to run onto the interception surface 11 (or one of the interception surfaces 11) of the barrier so that proportionately more of the water is intercepted. Moreover, the arrangement of the insertion portion in the slot provides a further way of supporting the barrier in the cavity, so that the barrier may be installed without the use of support elements 1, particularly if the insertion portion is inserted slidingly into the slot as the barrier enters the cavity, and particularly if the insertion portion is configured to define a key 54 which retains the insertion portion positively in the slot, as further described below.

The slot may be cut to a depth of at least 5 mm but not more than 15 mm from the nominal surface plane of the wall, in which case the cutter of the cutting tool (e.g. a rotating abrasive disc, ball, or other body mounted on a spindle, or a combination of such bodies in a series arrangement as described below with reference to the alternative cutting tool 20) will project by 5-15 mm from the plane of the sliding surface of the cutting tool which engages the wall surface. More preferably, the slot may be cut to a depth of not more than 12 mm, still more preferably not more than 10 mm from the wall surface, in order that the strength of the wall should not be compromised. It will be understood that in this context, the depth or distance is defined as the distance between the reference plane and the furthest extremity of the slot in a straight line normal to the reference plane.

Advantageously, the slot may be angled, preferably upwardly into the masonry to form an acute angle of for example about 45 degrees with respect to the nominal vertical reference plane representing the surface of the outer leaf of the wall. This allows the insertion portion to extend upwardly so that water seeping through the surface region of the masonry tends to run down the interception surface 11 into the channel formed by the barrier. The angle of the slot also means that the depth of the slot along its axis may be greater than its depth as measured normal to the reference plane, so that the insertion portion can be proportionately longer, which helps to ensure that the water is directed into the channel and also helps to transfer the load from insulation resting on the barrier to the outer leaf. By arranging the slot along a horizontal mortar joint, the shallow depth of the cut is found to be sufficient to provide penetration of the masonry all along the wall, even where vertical joints are badly washed out between courses. Advantageously, an upwardly or downwardly angled slot will extend into the undamaged bricks proximate the joint so that the insertion portion can mechanically support the barrier.

In practice, it is found that even where the insertion portion extends angularly upwardly into the masonry, its upwardly facing surface may have a longer contact area than its downwardly facing surface with the masonry, giving rise to undesirable capillary action which in areas where a large volume of water flows down inside the cavity can transport water around the insertion portion.

To overcome this problem, particularly in geographic areas which are subject to high rain penetration of the outer leaf, a water resistant composition 30 may be introduced into the slot to impede water flow around the insertion portion of the barrier. The water resistant composition is preferably flowable, e.g. a liquid, and may be arranged to change state, e.g. to set or harden, after it is introduced into the slot.

It could be for example a resin, such as an epoxy resin, which may be formulated to cure after some time in the presence of water or water vapour. It may be a single part composition or alternatively it could be a two part composition wherein the two parts are mixed before being introduced into the slot. It could be a single part silyl modified polymer composition which cures at room temperature. It may be Aminoethyl-aminopropyl methoxysilane and Bis (pentamethylpiperydil) Sebacate, available as "MS359" from Permabond Engineering Adhesives Ltd. of Hampshire, United Kingdom. Those skilled in the art will recognise that other compositions may be used.

Alternatively, where the composition is introduced into the slot before sliding the insertion portion of the barrier along the slot, as described below, the composition may be lubricious and, optionally, non-setting. For example, it may be a water repellent liquid which is formulated to penetrate and/or to line the pores of the masonry of the wall so that water is repelled from those regions into which the composition has penetrated. Suitable water repellent liquids include masonry sealers as known in the art.

Figure 26B:
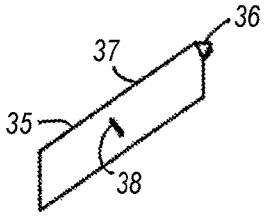
FIGS. 26A and 26B show the dispensing tool of FIGS. 6 and 7.
Figure 26A:
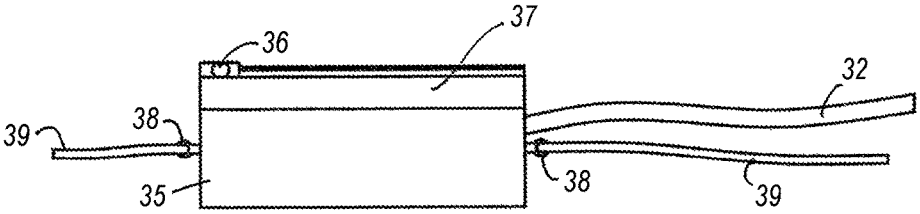

FIGS. 26A and 26B show how an injection or dispensing tool 35 separate from the cutting tool is slidingly supported by the barrier 10 while travelling along the slot 22. The low viscosity water resistant composition may be fed via flexible pressurised supply tube 32 to a nozzle 36 of the tool 35 which comprising a plastics body 37 on which the nozzle is mounted in fluid communication with the tube 32. The body has attachments 38 at either end to which cords 39 can be attached so as to pull the tool through the cavity when it is slidingly supported by the barrier in the installation configuration as shown in FIGS. 6 and 7, which show two alternative ways of supporting the tool on the barrier. In this position the nozzle 36 extends into the slot 22 and a ledge formed on the tool body proximate the nozzle slidingly engages the slot so that the tool presses the lower barrier portions 56, 57 down onto the support pins or rods 1 as it travels along the cavity. After the tool reaches the end of the cavity it is recovered via the respective hole 6, leaving the slot filled with the composition as shown in FIG. 8, at which point it is ready to receive the insertion portion 52 of the barrier.

In the installation configuration as shown in FIG. 7 the first and second barrier portions are superposed, i.e. they are arranged in flat, face to face abutment. Therefore it will be understood that the elastomeric joint 80 is arranged to resiliently bias the barrier portions away from the installation configuration through the deployed configuration and back towards the flattened, storage configuration.

Therefore it will be understood that during installation of the barrier, the barrier portions are moved from the storage configuration through the deployed configuration to the installation configuration, and then moved from the installation configuration back to the deployed configuration. Advantageously, this final step may be accomplished after inserting substantially the full length of the barrier into the cavity, so that the barrier slides more easily through the cavity in the installation configuration, and then is urged resiliently outwardly by the elastomeric hinge 80 in the deployment configuration so that it adapts to the width of the cavity.

Figure 8:
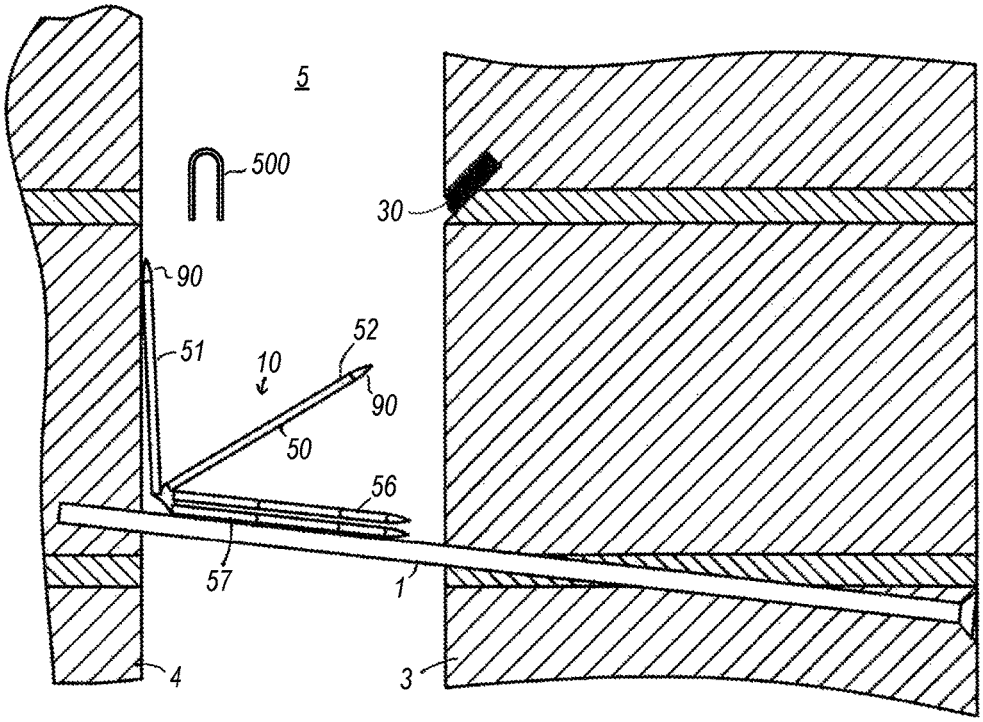
FIG. 8 shows the first barrier of FIG. 7 after removal of the clip.

The clips 500 are then slidingly pulled off the barrier and retrieved via the hole 6 in the wall so that the upper barrier portions move out towards the deployed position (FIG. 8). The barrier portions are very rigid along the length direction of the barrier in their own plane, but flexible enough to move out of their own plane as they are inserted sinuously into the cavity. This means that the barrier is remarkably rigid when in its cruciform X shaped configuration. In practice it is found that due to the elasticity of the joint 80 and its tendency to move towards the cruciform deployed configuration, together with the rigidity of the barrier in the plane of the barrier portions in its length dimension, only a very slight degree of manipulation from one end of the barrier is sufficient to permit the elastic joint to raise the barrier from the installation configuration of FIG. 7 via the released configuration of FIG. 8 to the extended, deployed configuration of FIG. 9 in which the insertion portion 52 enters into the soft composition in the slot 22, aided by the resilient fin 90 which helps it to move over the wall surface until it finds the slot. This automatic recovery of the barrier towards the cruciform, deployed configuration is found to be so reliable that it is typically not necessary, particularly on a short length of wall, to manipulate the barrier other than at one end in order for the insertion portion 52 to enter into the slot along the full length of the barrier. However, if manipulation is required along the length of the barrier, particularly on long walls, then this may be accomplished via holes in the outer leaf where bricks are removed to facilitate the later connection of drains to the channel 12 formed by the barrier in its installed position, and the clips 500 may likewise be detached via these holes.

Figure 9:
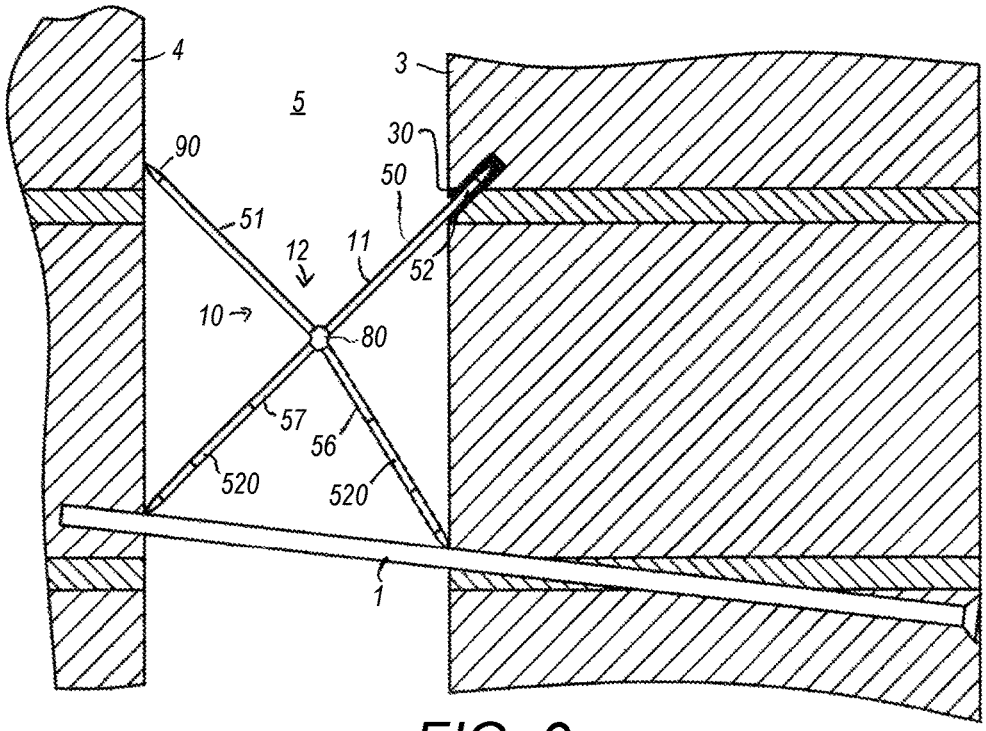
FIG. 9 shows the first barrier of FIG. 8 in the deployed position after insertion of the insertion portion into the slot.

After removing the clips 500 it can thus be seen that the insertion portion 52 is introduced into the slot by moving the barrier portions from the installation configuration (FIG. 7)

to the deployed configuration, so that the barrier portions are arranged to define a cruciform arrangement in the deployed configuration (FIG. 9).

FIGS. 15-19 show alternative barriers similar to the first barrier 10, each comprising first, second, third and fourth barrier portions 50, 51, 56, 57 joined by an elastomeric hinge to form a cruciform arrangement in the deployed position as illustrated. The insertion portion 52 may comprise a key 54 to retain the barrier in the slot 22, either forming a rigid part of one barrier portion (FIG. 16) or connected to a barrier portion by an elastomeric hinge or hinges (FIG. 19), and may be formed on an upper or lower barrier portion.

Figure 13A:
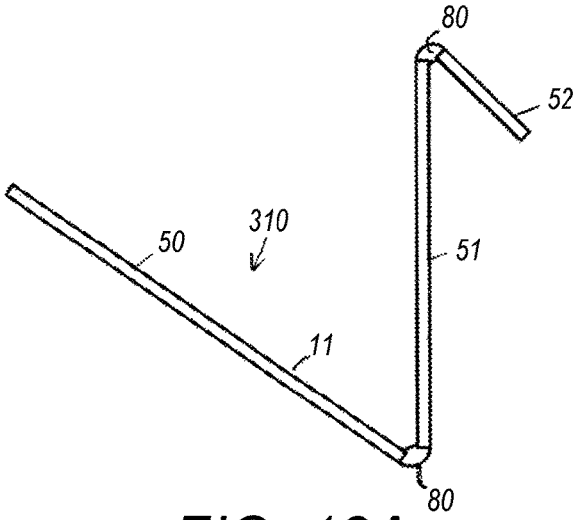
FIG. 13A shows a further alternative barrier.
Figure 13C:
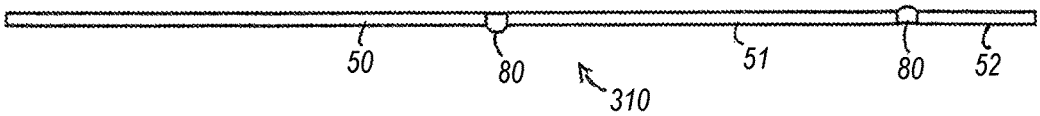
FIG. 13C shows the barrier of FIG. 13A in the flattened storage configuration.
Figure 14B:
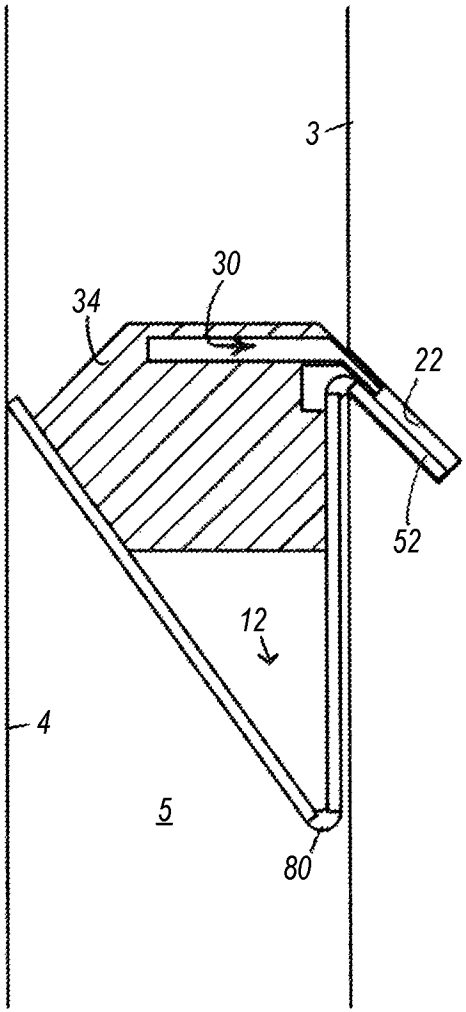
FIG. 14B shows the barrier of FIG. 13A in the deployed position with a second dispensing tool slidingly supported on the barrier and injecting a water resistant composition into the slot.
Figure 14A:
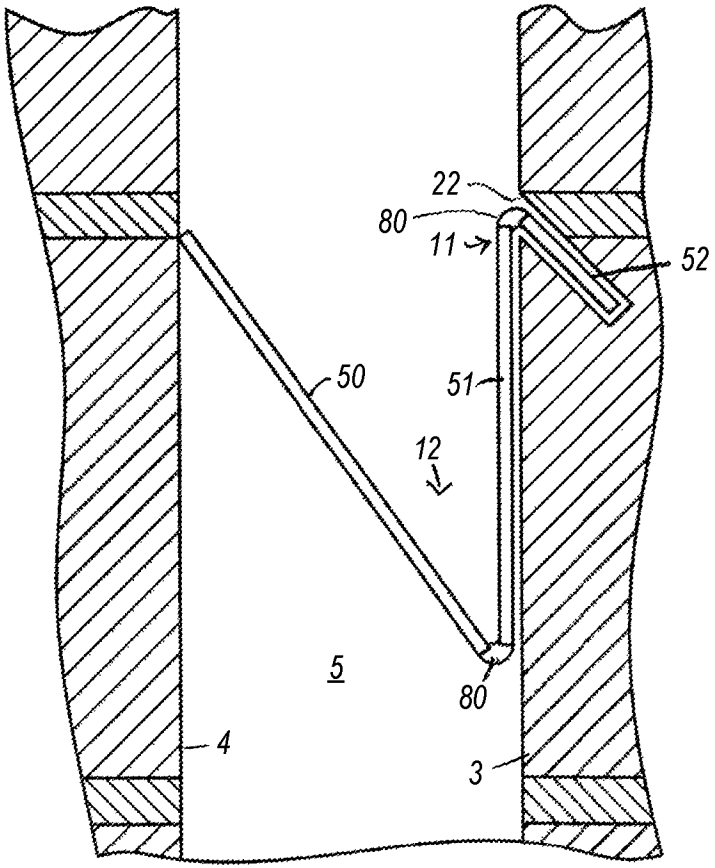
FIG. 14A shows the barrier of FIG. 13A in the deployed position with the insertion portion in the slot.
Figure 15:
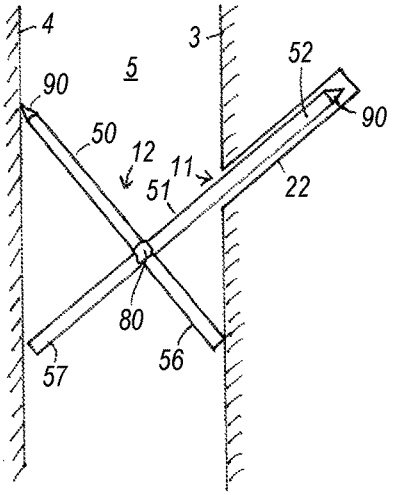
FIGS. 15-19 show further alternative barriers.

FIG. 13A shows an alternative barrier comprising first and second barrier portions 50, 51 joined by an elastomeric hinge 80, and an insertion portion 52 joined to the first and second barrier portions by another elastomeric hinge 80. In the flattened, storage configuration (FIG. 13C) the barrier portions are arranged in flat juxtaposed relation on coil. The barrier is manufactured by extruding it in the flattened configuration so that when the first and second barrier portions are closed together in superposed relation in an installation configuration so that they can be sinuously inserted through the hole 6 in the wall, they tend to spring apart into the extended, deployed position (FIG. 14A) in which they define a V-shaped channel, with one of the barrier portions extending vertically downwardly against the outer leaf and the other diagonally upwardly from the hinge 80 towards the inner leaf. This is a strong, stable configuration which resists bending in a vertical plane. The insertion portion is inserted into a slot 22 to transfer the load from the barrier and any insulation above it to the wall. Support elements 1 can be used if required. The slot 22 can be filled with a water resistant composition injected alongside the insertion portion 52 from a tool 34 which is moved slidingly along the barrier in its installed position (FIG. 14B).

Figure 12:
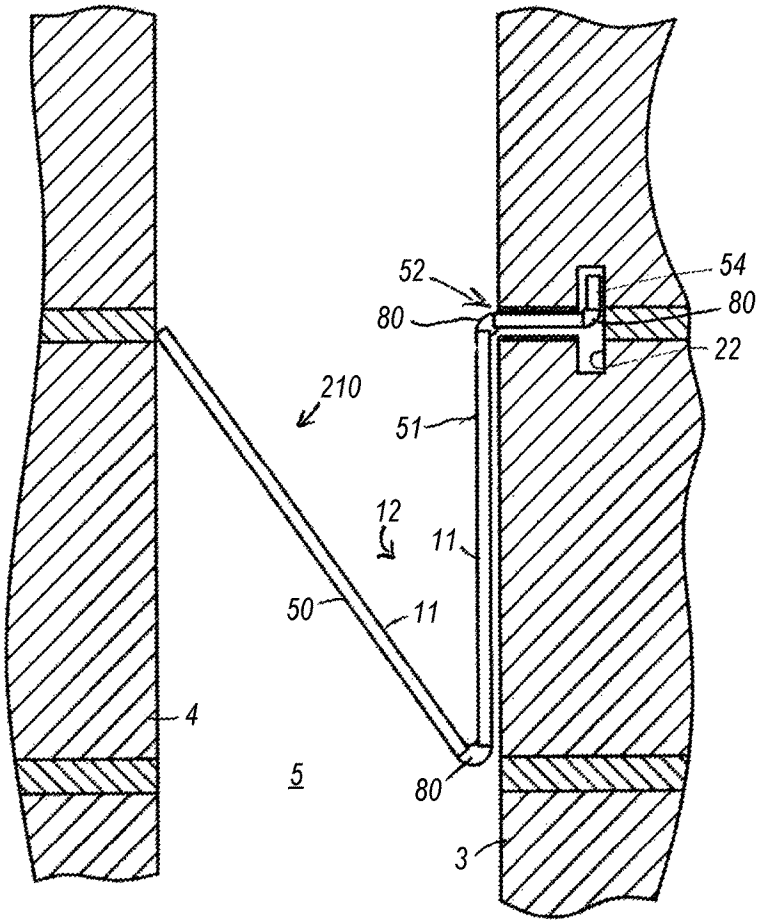
FIG. 12 shows a further alternative barrier in the deployed position, in which the insertion portion is configured to form a key for retaining the barrier in the slot.
Figure 11:
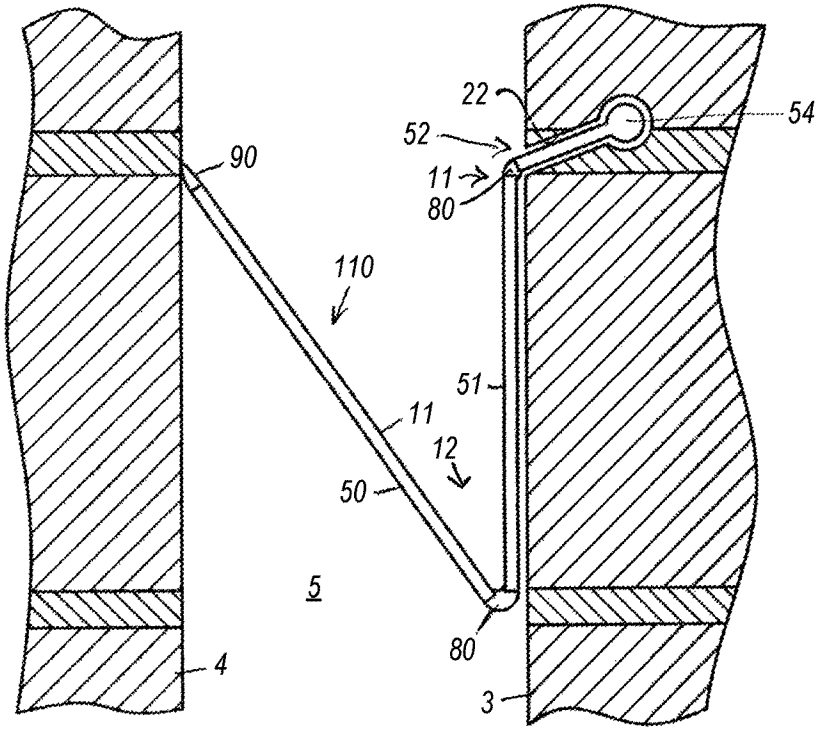
FIG. 11 shows an alternative barrier in the deployed position, in which the insertion portion is configured to form a key for retaining the barrier in the slot.
Figure 19:
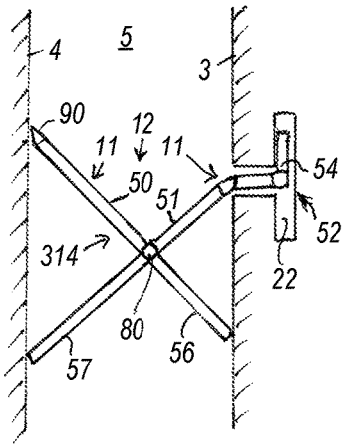
Figure 20A:
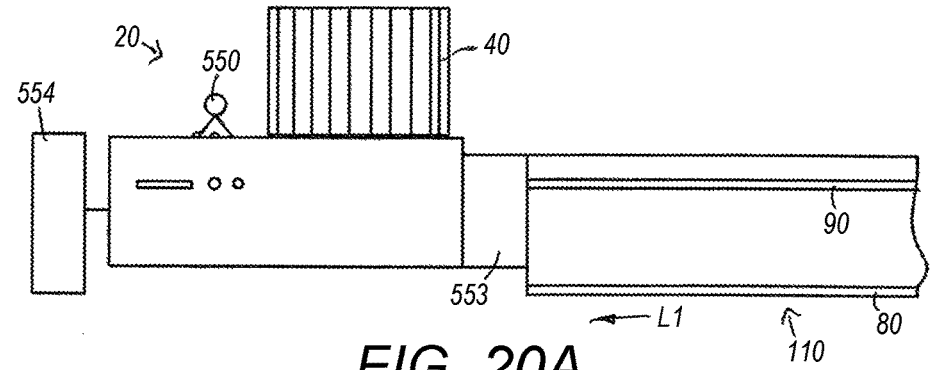
FIGS. 20A and 20B are respectively a side and a top view of a cutting tool for cutting the slot, removing protrusions, injecting resin, and pulling the barrier into the cavity, wherein the tool is powered via a cable for driving engagement with the internal surfaces of the cavity wall.
Figure 20B:
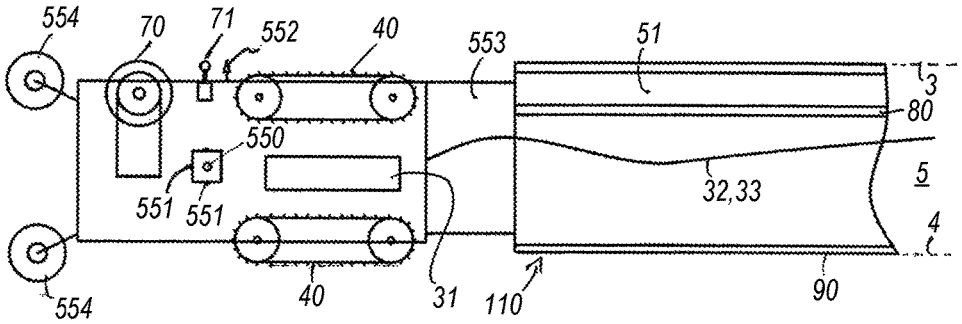

In the examples of FIGS. 11 and 12 and FIGS. 16 and 19, the insertion portion 52 defines a key 54 which retains the insertion portion in the slot in the deployed position against removal other than by sliding in a length direction of the barrier. The key can be a thickened region of the insertion portion or alternatively can be a narrow barrier portion forming part of the insertion portion which is hingedly attached to another part of the insertion portion, advantageously by another elastomeric hinge region as shown in FIGS. 12 and 19, with the slot being arranged to retain these two parts of the insertion portion at an angle to one another, i.e. in non-collinear relation, when considered in cross-section as shown in FIGS. 12 and 19, so that the key cannot be pulled out of the slot in the direction of that part of the slot which opens into the cavity. The slot 22 is cut by one or more cutters selected to obtain the required shape, and the insertion portion 52 is slidingly inserted into it as the barrier enters the cavity. Advantageously, as shown in the examples of FIGS. 11 and 12, the key supports the weight of the barrier and any insulation above it in the slot so if desired the support pins 1 may not be provided.

FIGS. 20A-21B show an alternative cutting tool which can be used to cut the slot 22 to receive the key 54.

The tool 20 has tracks 40 or other drive means such as wheels powered by motors to drivingly engage the wall surfaces of the inner and outer leaves to urge the cutting tool along the cavity. The tracks may be rubberised and arranged to frictionally retain the tool in a horizontal plane, and may be resiliently biased outwardly and/or moveable outwardly and inwardly to grip the wall surfaces, so that the tool need not be supported by support pins 1. The tracks are driven by motors (e.g. electric or air motors). The tool 20 includes a camera 550 and lights 551 to illuminate the cavity so the operator can observe and remotely control the operation of the tracks, cutting heads and other functions of the tool. The tool may be equipped with an inclinometer or level sensor or the like and an attitude control means for altering the attitude of the tracks so as to keep the tool aligned with the target mortar joint. This could be done by a control system e.g. using an optical sensor which senses the position of the mortar joint, or by manual control by an operator who observes the position of the tool via camera 550.

The barrier (e.g. barrier 110, 210, or 310) is releasably attachable to the cutting tool, for example, by arranging the releasable attachment means 553 of the cutting tool with retractable jaws or studs to grip surfaces or engage in holes in the end region of the barrier or in an end cap (not shown) which may be attached to the barrier to close the end of the channel 12 before inserting the barrier into the cavity, as further explained below. The attachment means is released remotely when the barrier has reached the installed position. This enables the cutting tool to pull the barrier into the cavity as the tool cuts the slot 22. In addition, the rigidity of the barrier in the plane of the flat barrier portions supports the cutting tool and maintains it in horizontal alignment as it travels through the cavity. This can be accomplished by slidingly inserting the insertion portion 52 of the barrier into the slot 22 as the barrier enters the cavity. (Since the insertion portion is inside the slot it is not visible in the schematic drawings which represent the tool and barrier in position inside the cavity.)

The tool 20 has two rotating cylindrical cutters 554 for removing extruded mortar and other dirt and projections from the wall surfaces. Like the flat leading edges of the simple tool 21, the rotating cutters 554 of tool 20 provide a surface preparation tool which is moved slidingly along the cavity to remove protrusions from at least the wall surface of the said respective one of the leaves.

A disc 70 and router bit 71 cut the slot and recess to receive the key. Both are retractable to the position shown in FIG. 21B so the router continues to rotate while moving along its rotation axis to cut its way out of the slot 22 at the end of its run when the barrier is in the deployed position. Thus it can be understood that once the tool has reached the end of the cavity, the insertion portion of the barrier which is pulled behind the tool will be inserted into the cavity for nearly the full length of the barrier. The insertion portion can be cut back at the end of the barrier to allow space for the tool to retract its cutters and move back along the barrier, leaving the barrier in its installed position. Thus only the diameter of the leading cutters 554 needs to be accommodated in front of the leading end of the channel 12 formed by the barrier. The body of the tool is configured to occupy the space inside the channel when all the cutters are retracted, and the tracks 40 are arranged to grip the walls above the barrier so that the tool can travel back along the barrier. The cutters 554 can be arranged to clear also those parts of the wall engaged by the tracks, or the tracks could be arranged alternatively in front of the tool and then when the barrier is installed, retracted and the tool returned along the barrier using separate power, e.g. wheels gripping a respective part of the barrier. Of course, the tool could be recovered via another hole at the end of the cavity instead of travelling back the way it came.

Of course, the tool could be powered by a rechargeable battery and remotely controlled by a wireless transmitter instead of an umbilical.

In order to install the barrier in a cavity which already contains insulation such as expanded beads bonded lightly together with resin, the leading cutters 554 of the tool may be used to comminute the insulation, and a vacuum line may be arranged to extract the comminuted insulation from the cavity, so that the tool forms a tunnel through the insulation as it cuts the slot (if a slot is required). New insulation may then be introduced to fill the tunnel, e.g. by blowing it through the same line as the tool is withdrawn leaving the barrier in the cavity.

Figure 21A:
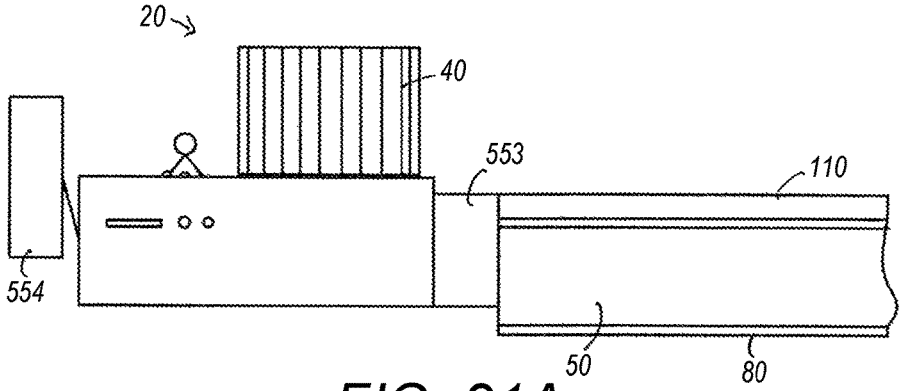
FIGS. 21A and 21B are respectively a side and a top view of the cutting tool of FIGS. 20A and 20B after installation of the barrier, wherein the cutting heads are retracted to clear the barrier as the tool returns along the barrier in the deployed position of the barrier to recover the tool from the cavity.
Figure 21B:
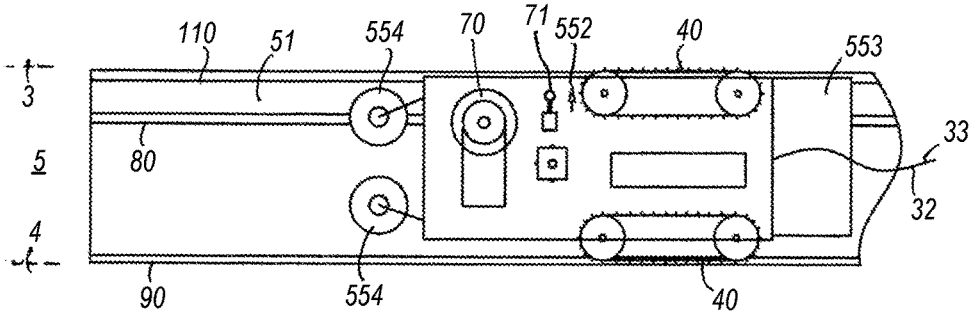
Figure 22A:
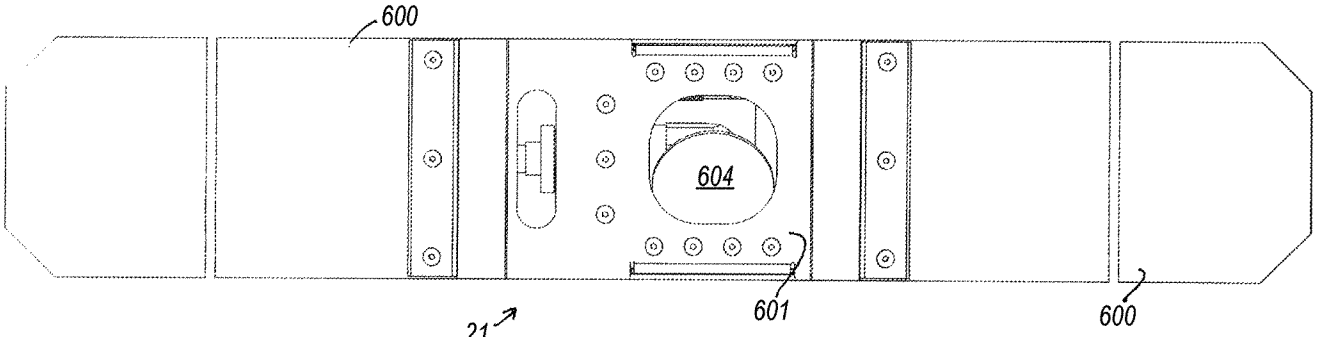
FIGS. 22A, 22B and 22C show a second cutting tool with skids for slidingly supporting the tool on pins extending into the cavity as the tool moves along the cavity, the tool having a cutting disc driven by an air driven motor for cutting the slot.
Figure 22B:
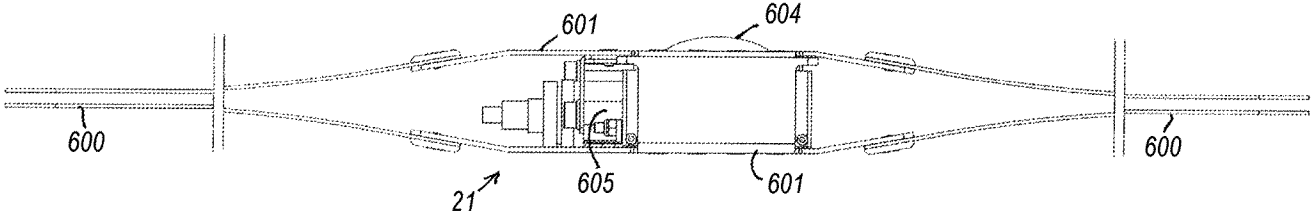
Figure 22C:
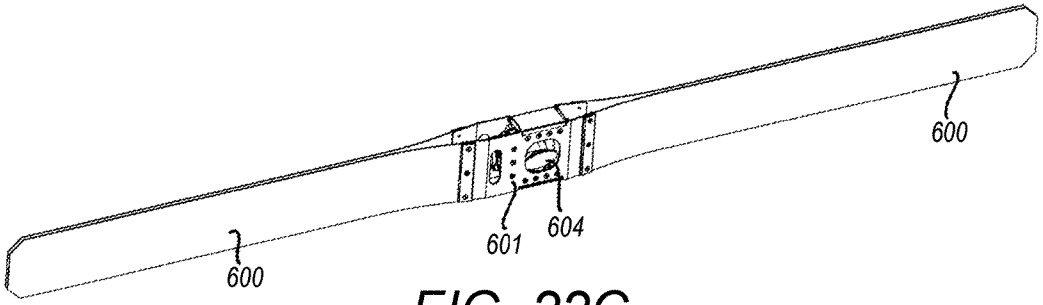
Figure 23A:
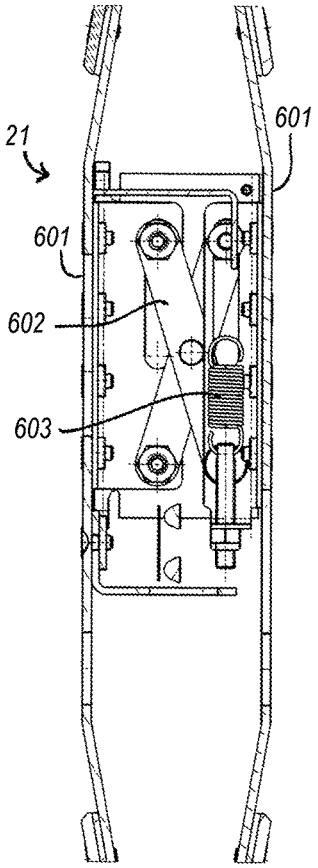
Figure 23E:
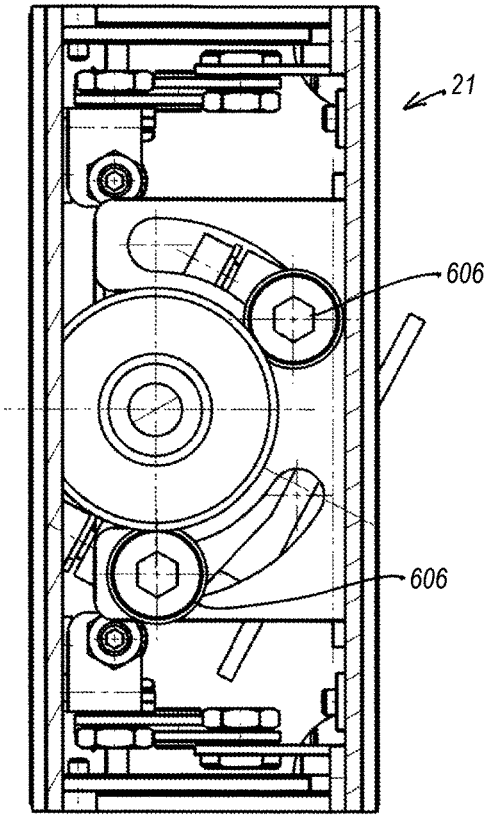
Figure 23D:
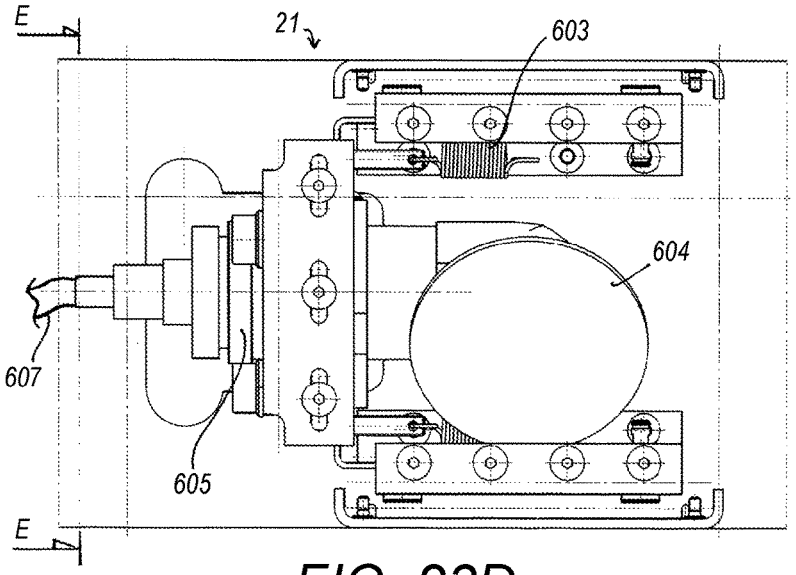
Figure 23B:
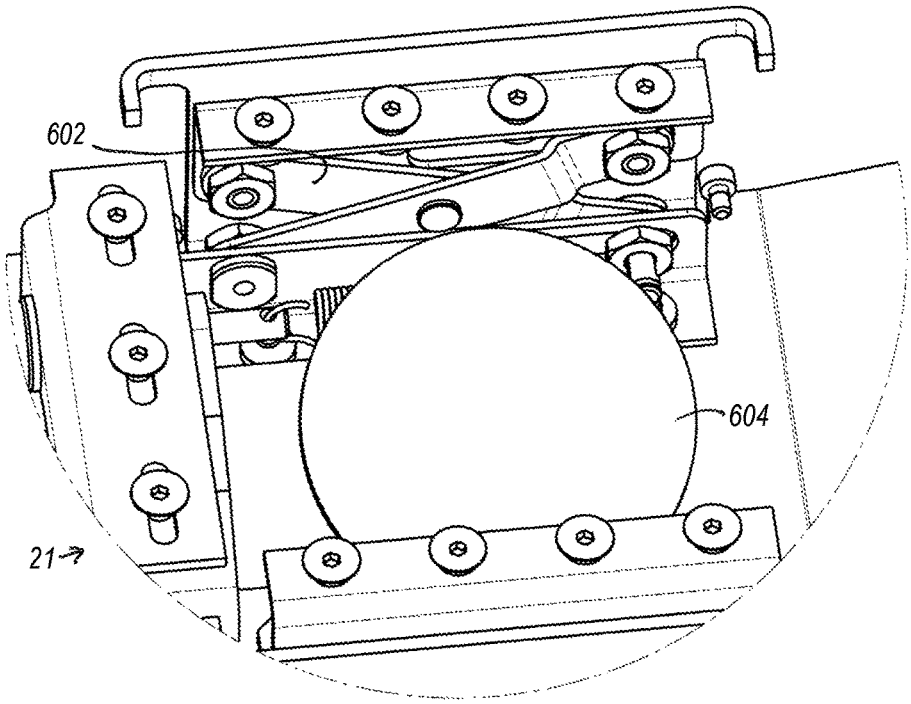
Figure 23C:
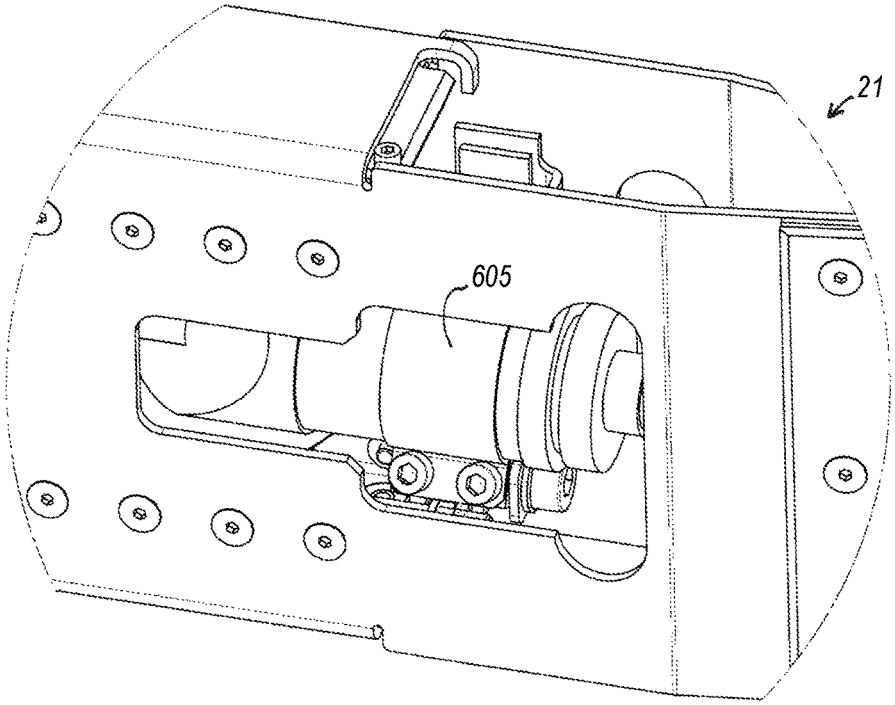
Figure 24:
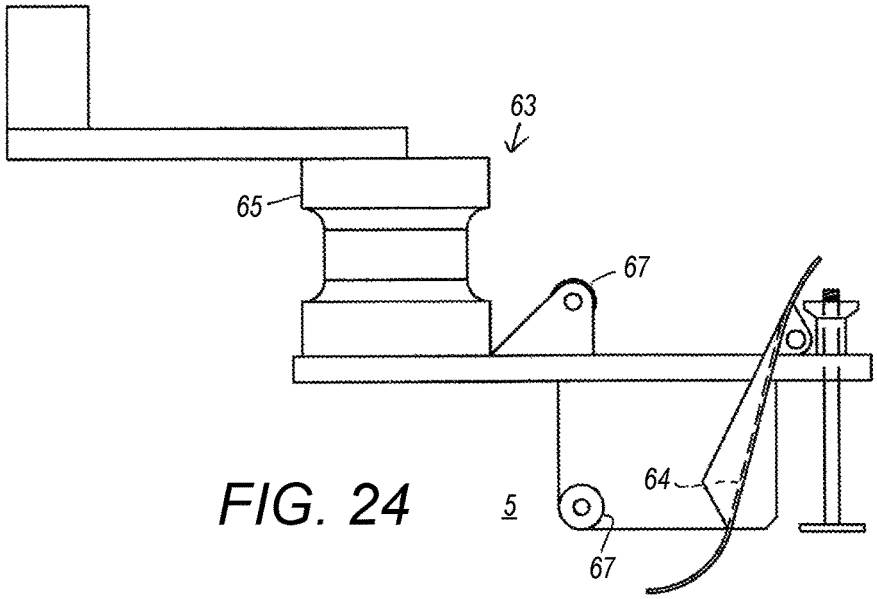
FIGS. 24 and 25 show respectively a guide with a winch for receiving a pull rope for pulling the barrier through the cavity, and a guide for inserting the barrier into the cavity.
Figure 25:
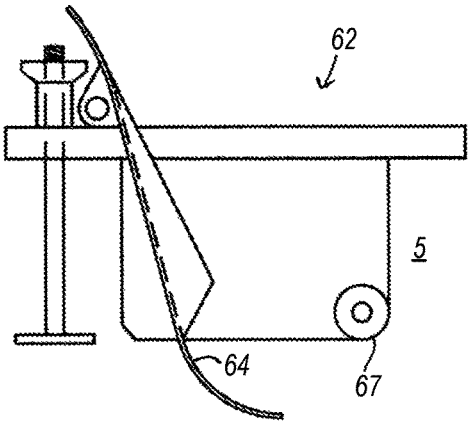

The tool 20 may include an injection tool mounted on the cutting tool, comprising an injection head 552 for extruding the flowable water resistant composition 30 and injecting it into the slot 22, which like the cutters may be retractable to the position shown in FIG. 21B. The injection tool can be arranged to inject the composition into the slot immediately behind the cutting tool as the tool moves through the cavity to cut the slot, either pulling the barrier behind it (in which case the insertion portion is introduced slidingly into the slot so that it slides along the slot immediately behind the cutting tool, and the composition is preferably lubricious to assist it to slide), or alternatively with the barrier being introduced after removing the tool, in which case the barrier may be slidingly inserted into the slot or alternatively may be slidingly inserted into the cavity in an installation configuration and afterwards manipulated to move from the installation configuration to the deployed configuration in which the insertion portion enters into the slot by a short movement transverse to the length dimension of the barrier, as shown in the example of FIGS. 8 and 9.

Alternatively, the injection tool or head 552 may be mounted on the cutting tool 20 and arranged to inject the composition 30 into the slot after the slot has been cut along the whole length of the cavity, on a return journey of the tool 20, which may be independent of the barrier (the barrier being inserted after removal of the tool) or alternatively may be accomplished by the tool moving slidingly back along the length of the barrier with the cutters retracted but the injection tool or head 552 engaged in the slot 22. In this latter case the insertion portion 52 of the barrier may be inserted already into the slot 22, either by pulling it along behind the tool 20 so that the insertion portion slides along the slot or by introducing it after cutting the slot by manipulation in the transverse direction as shown in the example of FIGS. 8 and 9. The injection tool or head 552 moves back along the slot injecting the composition 30 into the slot alongside the insertion portion 52 of the barrier as it goes. The composition may be contained in a cartridge 31 mounted on the tool 20, or alternatively can be fed via a pressurised supply tube 32 incorporated into the umblical line 33 which extends along the cavity and also supplies the tool 20 with power (e.g. electrical, compressed air, and/or hydraulic depending on the drive means of the cutters and tracks) and signals to and from the camera and drive controllers.

In the example shown, the router bit and disc cutter of the tool are arranged in series so that the spindle (rotation axis) of the bit is aligned with the diameter of the disc. This means that the disc cuts a slot to accommodate the spindle of the router, and the spherical head of the router enlarges the end of the slot before it is retracted to grind a circular hole at the end of its run. Diamond tools may be used so that they do not reduce appreciably in dimensions along the length of the slot, and in practical tests such tools have been found very suitable for cutting a slot through bricks and mortar. Where a T shaped slot is required, a second abrasive disc may be used instead of a router with a spherical end and arranged in similar relation to the leading disc so its spindle passes through the slot cut by the leading disc. The second disc may have an abrasive surface so that it too can be withdrawn (more slowly) by cutting a circular hole as it is retracted into the body of the tool at the end of its run. Alternatively of course the bits could be remotely detached and abandoned in the slot.

In the deployed position the interception surface 11 of each barrier is advantageously arranged to define a channel 12 extending along the length dimension of the barrier to convey the water intercepted by the interception surface to a drain or drains which discharge it outside the cavity. Preferably at least one drain 2 is fluidly connected to the channel to convey the intercepted water out of the cavity, and particularly on long walls, a plurality of such drains 2 may be arranged at spaced locations along the length dimension of the barrier, each drain 2 extending outwardly through a leaf of the wall, as shown in FIG. 1. This makes it possible for the barrier to follow the catenary curve of a (nominally) horizontal mortar joint without the channel overflowing in the middle.

Each drain may be fluidly connected to the channel via a respective aperture which is cut in the first barrier portion by a drill inserted through a hole in the outer leaf of the wall, e.g. having a short bit and a collar which restrains it from piercing more than one of the barrier portions, or by a tool such as a hand operated punch or hole cutter inserted through a hole formed by removing one or two bricks from the outer leaf. Of course, apertures could also be formed before inserting the barrier in predetermined positions, e.g. by aligning them with indicia printed on the barrier, so as to accurately align them with holes drilled in the outer leaf before or after installing the barrier.

Figure 10:
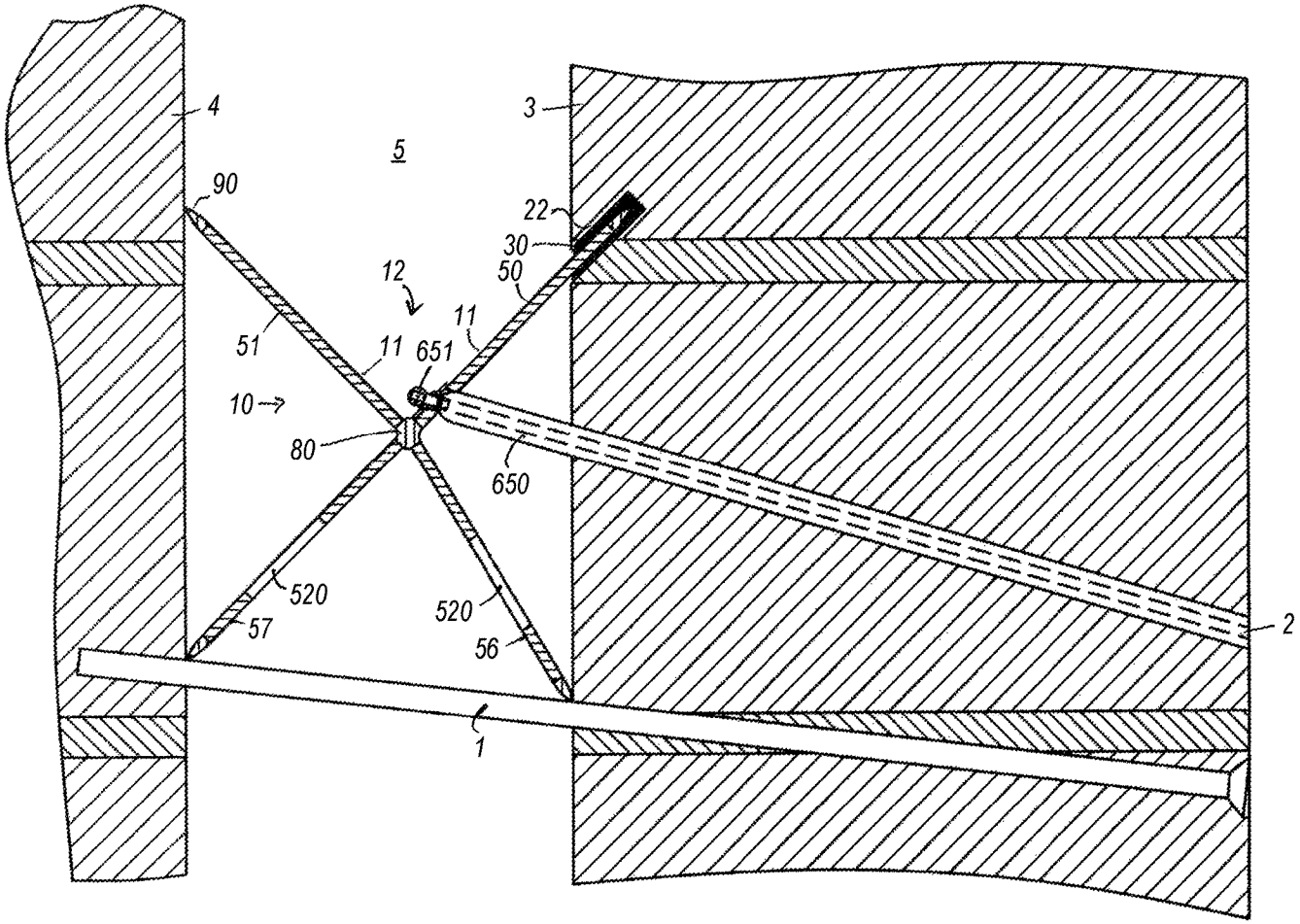
FIG. 10 shows the first barrier in the deployed position of FIG. 9 after installation of the drain and filter of FIGS. 3 and 4.

FIG. 10 shows how a drain can be connected to the channel 12 by inserting a drain pipe 650 through a hole in the outer leaf 3 of the wall and connecting it to an aperture in the respective barrier portion. The hole may be drilled in the wall or could be formed by removing bricks, arranging the drain pipe 650 in the position of the removed mortar joint, and reinstating the joint. A cap 651 comprising a domed filter for excluding insulation material from the drain can be connected to the pipe using glue or a friction fit and/or seals so that the drain pipe is fluidly connected via the filter to the channel 12. The drain pipe is cut flush with the outer surface of the outer leaf 3 of the wall.

Figure 13B:
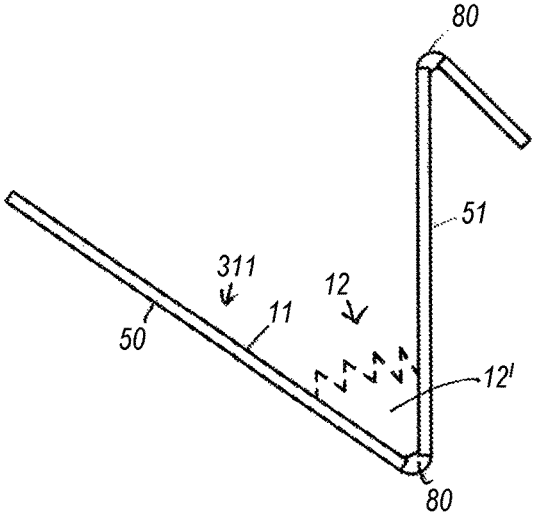
FIG. 13B shows a variant of the barrier of FIG. 13A including a filter extending along the length dimension of the barrier and resiliently biasing the barrier towards the deployed configuration.

In the example of FIG. 13B a barrier similar to barrier 13A comprises a filter which extends along the length dimension of the barrier to exclude insulation material from a water conveying region 12' of the channel 12 formed between the barrier portions, through which water may flow between respective ones of the drains when the drains are connected to that region via the barrier portions 50 or 51. The filter may be a folded, resilient, perforated sheet or mesh which applies an outward bias force to the barrier portions to urge them towards the flattened configuration and so towards the deployed configuration as shown when released inside the cavity.

Figure 30:
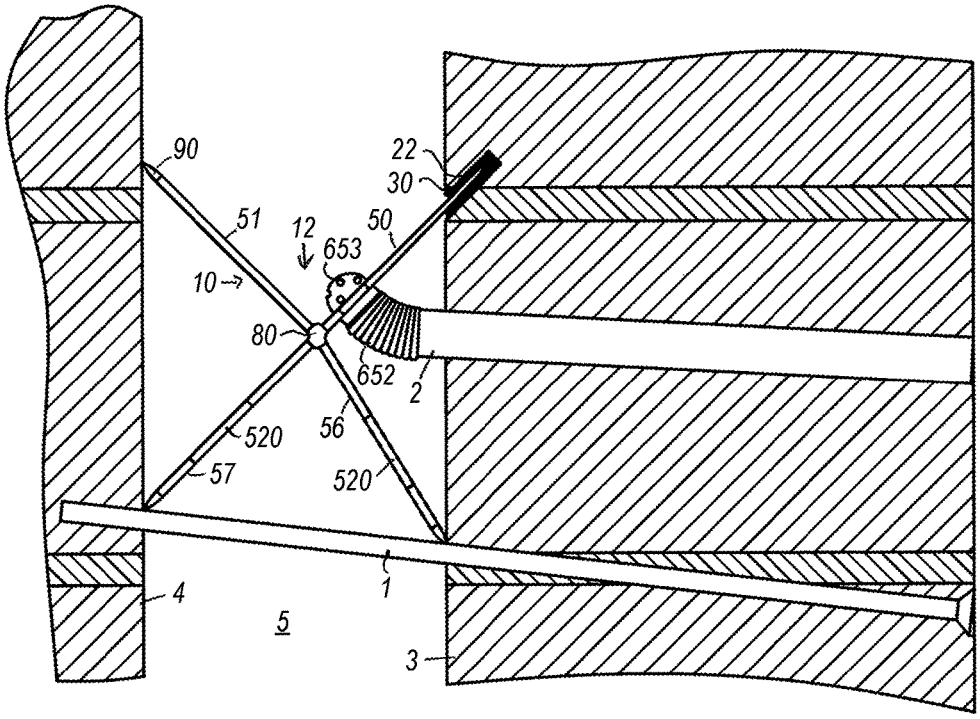
FIG. 30 shows an alternative drain installed to convey water away from a barrier out of the cavity through the outer leaf of the wall.

FIG. 30 shows how a drain 2 can be formed with a flexible portion 652 to adapt to the angle of the first barrier portion 50, which in turn depends on the width of the cavity in which the barrier is installed. A domed cap 653 acts as a filter in the channel.

Figure 31:
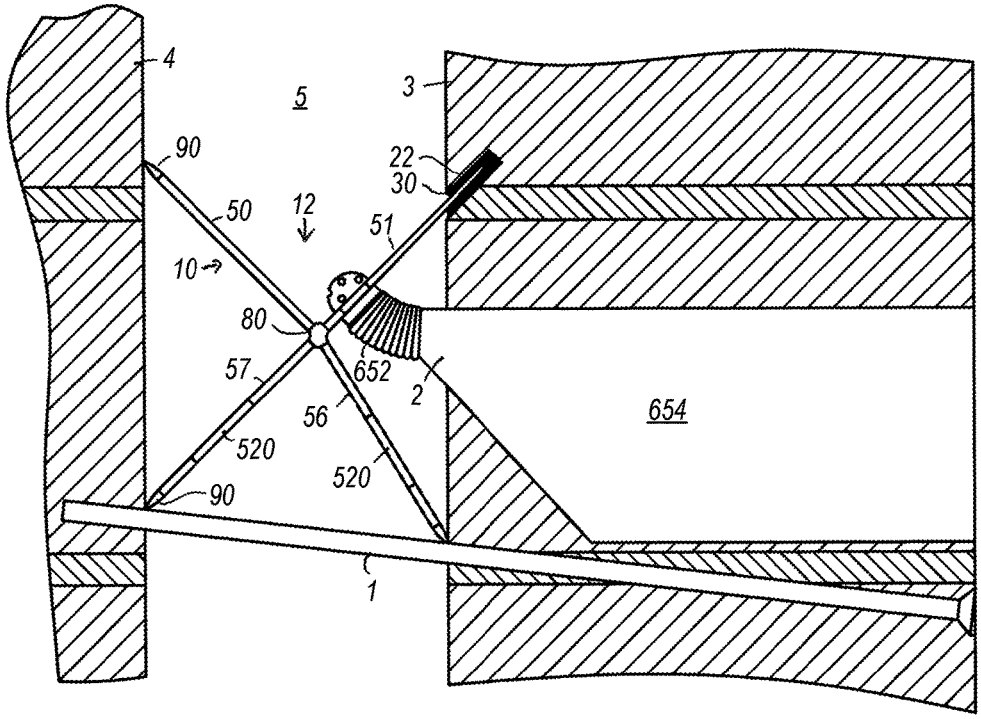
FIG. 31 shows a further alternative drain installed to convey water away from a barrier out of the cavity through the outer leaf of the wall.
Figure 32:
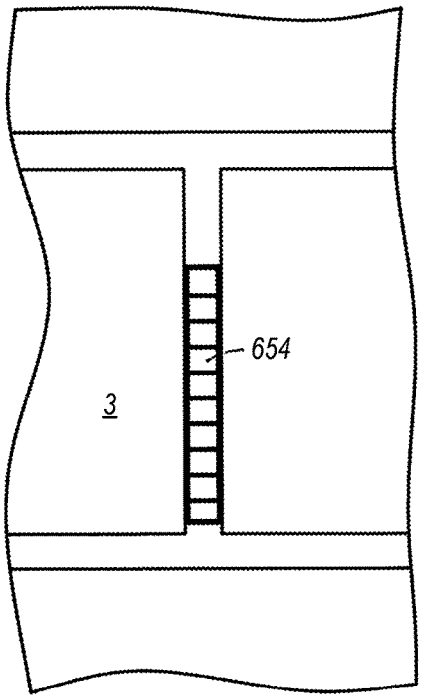
FIG. 32 shows the drain of FIG. 31 from the outer surface of the wall.

FIG. 31 shows a similar drain 2 which has a vertically enlarged body 654 to increase its water rejection capacity, and which is mortared into a joint of the wall as shown in FIG. 32.

Figure 33:
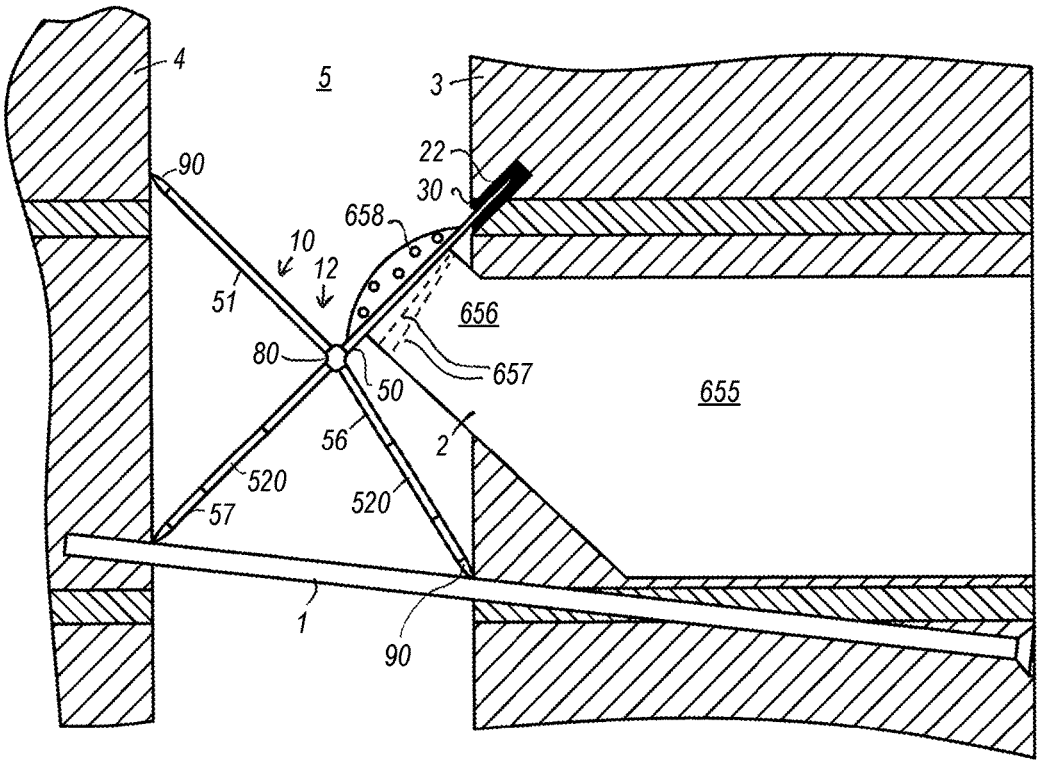
FIG. 33 shows a yet further alternative drain installed to convey water away from a barrier out of the cavity through the outer leaf of the wall.

FIG. 33 shows how a drain 2 with a similarly enlarged body 655 has a neck 656 that can be cut along a selected line 657 to match the angle of the barrier portion into which a slot is cut to receive it, with a domed cap 658 again acting as a filter to keep out insulation, particularly beads.

Figure 34:
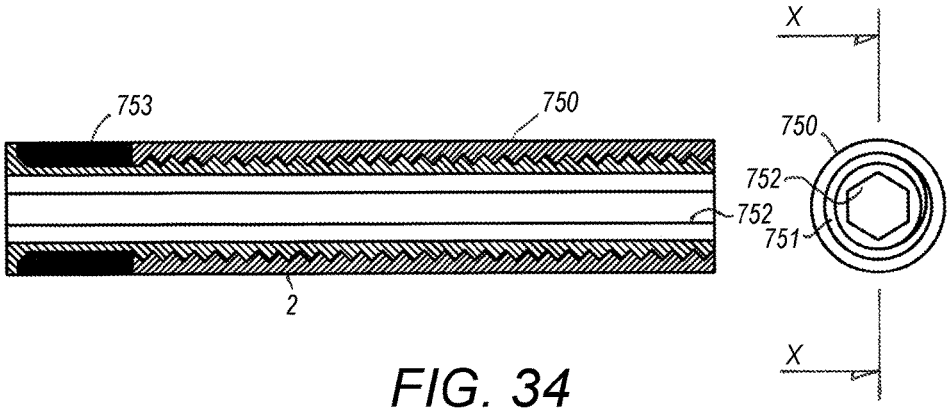
FIG. 34 shows a yet further alternative drain in end view and in longitudinal section along line X-X.
Figure 35:
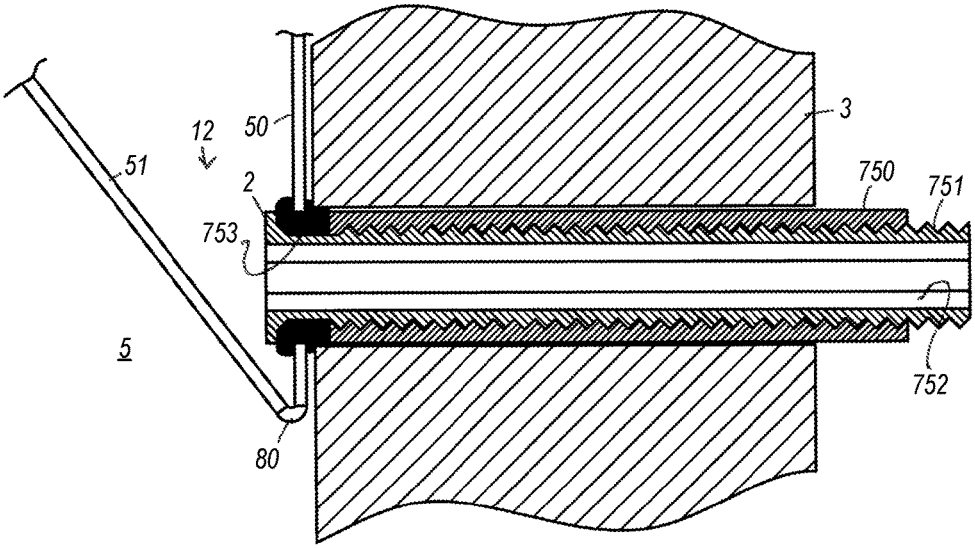
FIG. 35 shows the drain of FIG. 34 installed to convey water away from a barrier out of the cavity through the outer leaf of the wall.

FIGS. 34 and 35 show how a drain 2 can be formed from an outer sleeve 750 threadedly connected to an inner sleeve 751, the inner sleeve having a hexagonal bore 752 to receive a matching hexagonal key (not shown). A soft rubber ring seal 753 is arranged between axially opposed abutment surfaces of the inner and outer sleeves and positioned through a hole in the outer leaf 3 of the wall to engage in an aperture cut with a drill or punch in the barrier portion 50. The inner sleeve is rotated using the key relative to the outer sleeve to compress and expand the seal forming a fluid connection sealingly through the barrier portion to the channel, after which the drain can be cut flush with the outer surface of the wall.

Figure 36:
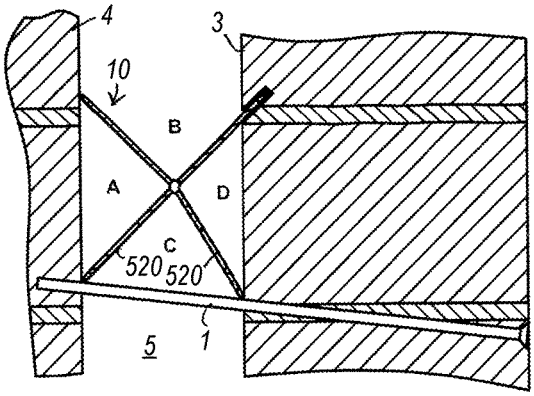
FIG. 36 illustrates the temperature gradient across the first barrier.

FIG. 36 illustrates a particular advantage of the cruciform configuration of the first barrier in which holes 520 or other apertures are formed in the lower barrier portions. When insulation (not shown) is introduced into the cavity it will pass through the apertures into the regions A and D on either side of the barrier. The upper barrier portions are imperforate so that they separate hot air rising from below from cold air collecting in the cavity space above the barrier. However, the apertures in the lower barrier portions allow air to diffuse into spaces A and D so that these zones are at an intermediate temperature, whereby the temperature gradient across each of the respective barrier portions is reduced. In summer the temperature of the outer leaf 3 will be relatively high so that the zones are arranged ABCD from coldest to warmest. In winter the leaf 3 is relatively cold so the zones are arranged DBAC from coldest to warmest. Advantageously, in each case moisture tends to condense on the barrier portions inclined downwardly and outwardly towards the outer leaf. Further advantageously, the condensation is reduced by the insulating effect of the intermediate zones.

Referring to FIGS. 29A and 29B, a water resistant composition may also be used to seal the interception surface 11 of a barrier to the outer leaf of the wall, even where no slot is provided. It will be noted that the interception surface 11 is that surface of the barrier which serves to intercept water flowing down inside the cavity, and hence can extend beneath the insertion portion as well as above it, as shown for example in FIG. 29B in which the downwardly facing interception surface is sealed by a water resistant composition 30 to the outer leaf of the wall.

Figure 37:
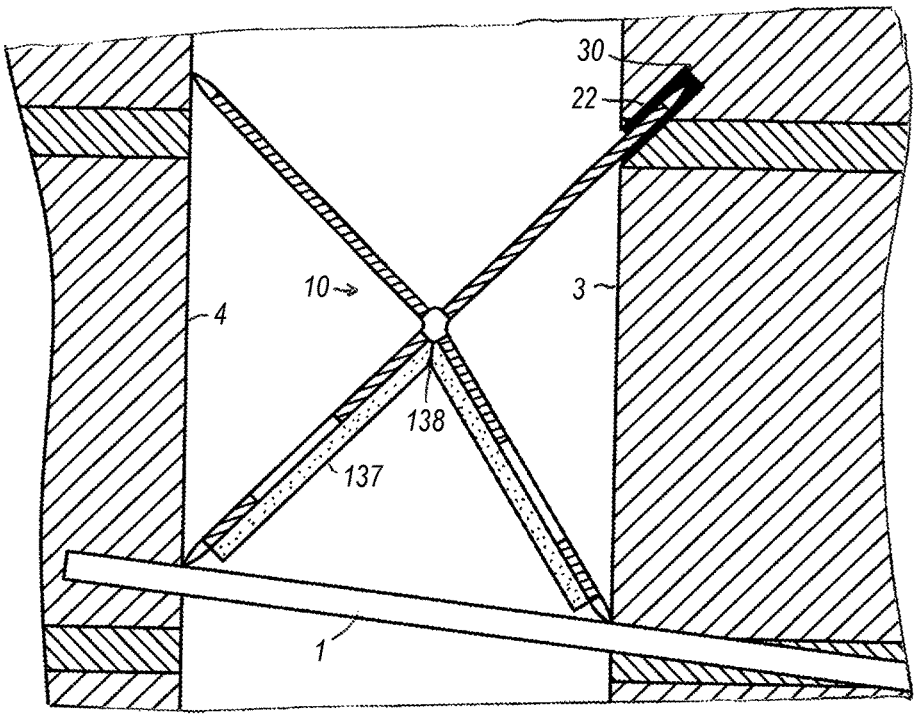
FIG. 37 shows a variant of the first barrier incorporating a thermal shield.

FIG. 37 shows a variant of the first barrier 10 incorporating an elongate thermal shield 137 which is fixed (e.g. by adhesive if the shield is applied as a separate strip or mat, or by spraying or otherwise applying the shield as a composition) beneath the downwardly facing surfaces of its two lower portions. The thermal shield 137 is arranged to protect the barrier 10 against fire and may comprise a layer or mat of glass or mineral fibre or other fire resistant or ablative material, optionally with a hinge region 138 (for example, a notch or notches on one or both of the upper and lower faces of the shield) proximate the central joint of the barrier so that the shield can be folded in use and rolled for storage as an integral part of the barrier. The shield may extend to the tips of the lower barrier portions or alternatively may be terminate just short of the tips as shown. In this embodiment the barrier 10 is particularly suitable for use in timber framed buildings where the shield extends e.g. for 30 minutes or more the time during which the barrier can withstand the heat of a fire without sagging or melting.

Figure 38:
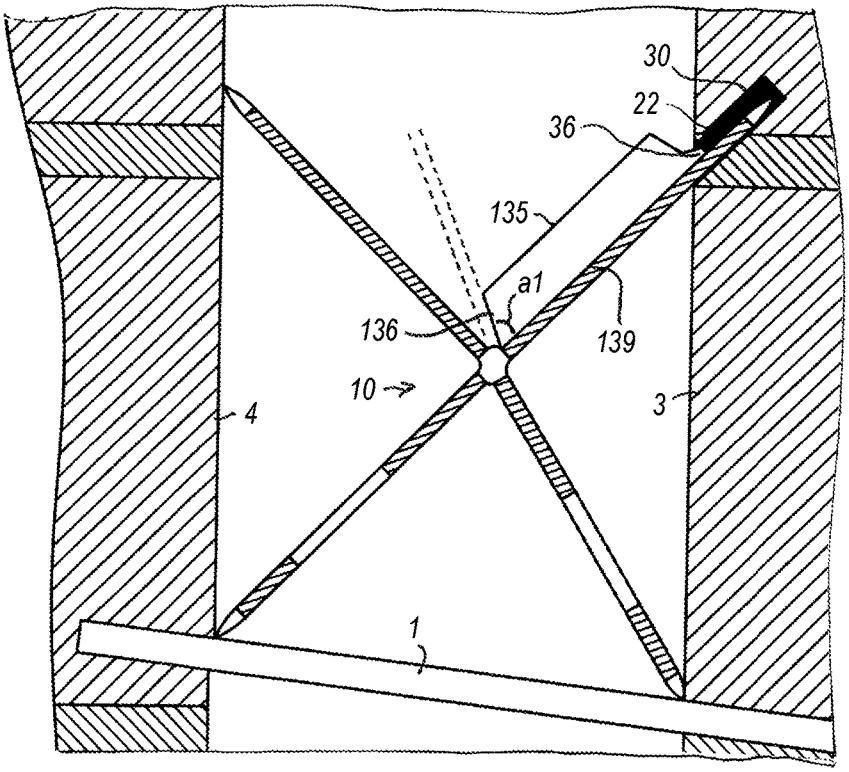
FIG. 38 shows another dispensing tool.

FIG. 38 shows an alternative dispensing or injection tool 135 similar to the tool 35 of FIGS. 6 and 7, having a nozzle 36 for injecting the resin or other water resistant composition 30 into the slot 22 in the outer leaf of the wall. The tool 135 is adapted to slide along the upper surface of the first barrier 10 within the cavity, so that it is not necessary to arrange the barrier 10 in an L-shaped configuration to support the tool within the cavity as shown in FIGS. 6 and 7. Instead, after inserting support pins 1 and cutting the slot 22, the barrier is inserted into the cavity so that an insertion portion of the barrier extends into the slot 22 in its deployed configuration as shown. Optionally, clips 500 or other means may be provided for restraining the barrier in the installation configuration as shown in FIG. 2A until it has been inserted for most or all of its length into the cavity, after which the clips are removed so that it springs back to the deployed configuration. Alternatively, the barrier may be inserted in the installation configuration of FIG. 2A and allowed to spring back to the deployed configuration of FIG. 38 as it slides into the cavity, optionally with the insertion portion sliding along inside the slot 22 until the barrier is in its final position. The tool 135 is then introduced into the cavity and slidingly supported on the barrier as it is pulled along the cavity using a rope (not shown) or the like, with the composition 30 being pumped along a flexible hose (not shown) in fluid communication with the nozzle, or alternatively being expelled from a cartridge (not shown) mounted on the tool. The nozzle 36 is arranged to inject the composition 30 alongside the insertion portion of the barrier into the slot 22, with the nozzle being maintained in the correct position irrespective of the width of the cavity by the abutment of the tool against the central joint of the barrier 10. The narrower side surface 136 of the tool opposite the nozzle is arranged at an acute angle a1 relative to its wider, base surface 139 which slides along the upwardly facing surface of the barrier 10 in use. This allows the tool to be used even when the barrier is folded to fit into a narrower cavity as indicated by the dotted lines showing an alternative position of the upper limb. In narrow cavities, the injection tool may apply pressure to the limbs of the barrier to urge it into the desired position.

In summary, preferred embodiments provide a flexible, elongate barrier comprising relatively rigid barrier portions connected by elastomeric joints which is introduced slidingly into the cavity of a cavity wall and sealed to the outer leaf of the wall by introducing a portion of the barrier into a slot cut in the inner surface of the wall and/or by providing a water resistant composition which may be injected into the slot. The barrier may form an X or V shaped configuration defining a channel from which water is discharged via drains from the cavity. The barrier portions may be arranged in a flat configuration when the barrier is stored on a reel and moved through a deployed configuration to an installation configuration against the resilient bias of the joint so that they spring out to the deployed configuration to conform to the width of the cavity after installation.

In each of the illustrated embodiments the barrier portions preferably are plastics extrusions, and the barrier preferably is manufactured by extruding the elastomeric hinges simultaneously with the barrier portions from a suitable extrusion die of a plastics extrusion machine.

In each of the illustrated embodiments which include an insertion portion, the insertion portion of the barrier forms an integral part of the barrier. In alternative embodiments the insertion portion of the barrier could be a separate element from the remainder of the barrier which is attached to the insertion portion (such as by slidingly coupling the two parts together) after introducing the insertion portion into the slot.

In the illustrated embodiments, the barrier portions are resiliently biased apart towards a deployed configuration to urge a part of the interception surface pressingly against a respective one of the leaves. Instead of injecting the water resistant composition into the cavity, the water resistant composition could be arranged on the interception surface of the barrier before inserting the barrier into the cavity, in which case the pressure of the interception surface being pressingly engaged against the wall surface may urge the composition against the wall so as to form over time an effective seal. For example, the composition on the interception surface could be covered by a protective layer during installation of the barrier in the cavity which is removed or dissolved after installation, or penetrated by the composition after installation, to bring the composition into contact with the wall surface.

Instead of connecting the drains to the barrier in the installed position of the barrier, the drains could be flexible tubes which are connected before inserting the barrier into the cavity, with the distal ends of the tubes hanging below the barrier so that they can be retrieved and pulled out through holes in the wall after the barrier is installed.

In yet further examples, the barrier could include a channel which is formed below the interception surface as a separate conduit to channel the water along the cavity between the drains.

In less preferred embodiments, the barrier portions could be made from a non-plastics material, for example from a metal, in which case they may be joined by a hinge region comprising a folded portion of a single metal strip which forms both barrier portions. A plastics barrier can similarly be provided with an integral hinge region rather than making the hinge region from a different, elastomeric plastics material from that of the more rigid barrier portions.

After installing the barrier, the ends of the channel 12 can be closed by cutting them at an angle and gluing a plastics plate or the like over the cut ends, working through holes in the outer leaf of the wall. Alternatively an end cap (not shown) can be attached to the leading end of the barrier before it is inserted into the cavity, in which case the end cap preferably is hinged so that the first and second barrier portions 50, 51 can be folded together and then can unfold inside the cavity to match the width of the cavity in the deployed position. The cutting and composition dispensing tool 20 can be releasably attached to the end cap to draw the barrier into the cavity, with the cutters overhanging the leading end of the end cap and being articulated so that they can be drawn up and inwardly together to a stowed position after the end cap nears the end of the cavity and before the tool returns along the cavity to be recovered via the hole in the wall from its initial insertion position. The drains can be provided only or additionally at the ends of the barrier, optionally in the end caps.

Two barriers may be installed at the same height or slightly different heights on two adjacent portions of the wall on either side of a corner of the wall, so that their respective ends closed by plates or caps abut or overlap at the corner inside the cavity, whereby water flowing down the cavity at the corner is intercepted by one or other of the barriers.

If access cannot be gained to the external face of the wall, then the barrier may be installed alternatively via a hole formed in the inner leaf. In either case, the installation hole may be formed centrally or part way along the wall between its extremities, and the barrier inserted in two lengths, each terminated by a plate or end cap. The two lengths may then be joined together or separately terminated with plates or end caps, conveniently by solvent welding, at the location of the hole.

In each of the illustrated examples where a slot is formed in the wall, a water resistant composition may advantageously be introduced into the slot as shown, either before, simultaneously with, or after introducing the insertion portion of the barrier, so that the composition is arranged between the interception surface 11 and the outer leaf of the wall.

In yet further embodiment, a slot may be formed in the outer leaf with a second slot being formed opposite it in the inner leaf, so that opposite insertion portions of the barrier (e.g. opposite extremities of two limbs of a cruciform barrier) can be inserted respectively into the first and second slots. Either or both of the slots may be filled with a composition as described above. Optionally, different compositions may be used for the first and second slots. In such embodiments, the cutting tool and the injection or dispensing tool may be adapted to include two (or two sets of) cutting elements or injection nozzles, so that both slots may be cut or filled simultaneously. Alternatively of course, the same tool may be used to cut or fill each slot, optionally by a first pass in a first direction for the first slot and a second return pass in the second, opposite direction for the second slot.

In yet further embodiments, as shown in FIGS. 29A and 29B, the barrier may include a conduit 29, comprising for example a thin plastics tube, the conduit extending along a length dimension of the barrier, and the water resistant composition may be injected into the conduit after inserting the barrier into the cavity. FIG. 29B shows how the conduit can be arranged between two barrier portions joined by an elastomeric hinge to form a channel 12 in the deployed position. The barrier portions restrain the composition so that it is pressingly engaged with the wall surface to form a seal.

In less preferred embodiments, instead of providing respective barrier portions to define a channel to which drains are connected for conducting the water out of the cavity, the barrier may comprise only one barrier portion 50 which may be arranged for example as shown in the barrier 315 of FIG. 29A together with a conduit 29 and/or body of water resistant composition 30 so that a shallow channel 12' is formed between the barrier portion and the conduit or water resistant composition. A drain could be connected to this small channel 12' in a similar manner to the channel 12 of the other examples. A single barrier portion may also be arranged without a drain so that it simply deflects water traveling down through insulation above the barrier back onto the outer leaf of the wall.

In alternative embodiments, the restraint means may comprise a series of individual clips, or adhesive portions arranged on opposed surfaces of the barrier portions and releasable e.g. by moisture, or any other suitable arrangement for releasably connecting the barrier portions together during installation. The restraint means could be released as the composition dispensing tool and/or cutting tool travels along the barrier, e.g. by an abutment surface of the tool which dislodges clips or the like as it passes.

In alternative embodiments, the barrier might include first and second upper barrier portions and only one lower barrier portions, or only one upper and one lower barrier portion. The barrier portions could be hinged together at their abutting edges or as shown in FIG. 29B part way along the length of one of the barrier portions when considered in cross section or end view.

Many further adaptations are possible within the scope of the claims.

The invention claimed is:

1. A method of installing a barrier to intercept water travelling downwardly through a cavity between opposed wall surfaces of two leaves of a cavity wall; comprising:

providing an elongate barrier, the barrier including an interception surface which extends along a length dimension of the barrier;

slidingly inserting the barrier into the cavity;

supporting the barrier in the cavity in a deployed position wherein the interception surface is arranged to intercept the water travelling downwardly through the cavity;

introducing a cutting tool into the cavity;

operating the cutting tool to cut an elongate slot in one of the wall surfaces; and introducing an insertion portion of the barrier into the slot.

2. A method according to claim 1, wherein a water resistant composition is introduced into the slot to impede water flow around the insertion portion of the barrier.

3. A method according to claim 1, wherein the said one of the wall surfaces comprises bricks or blocks separated by horizontal mortar joints, and the slot is cut along one of the horizontal mortar joints.

4. A method according to claim 1, wherein in the deployed position the barrier defines a channel extending along the length dimension of the barrier to convey the water intercepted by the interception surface;

and a plurality of drains are arranged at spaced locations along the length dimension of the barrier, each drain extending outwardly through a leaf of the wall, each drain being fluidly connected to the channel to convey the intercepted water out of the cavity.

5. A system for intercepting water travelling downwardly through a cavity between opposed wall surfaces of two leaves of a cavity wall, comprising:

an elongate barrier, the barrier including an interception surface and an insertion portion, the interception surface and the insertion portion extending along a length dimension of the barrier; and a cutting tool, the cutting tool being moveable through the cavity and operable to cut an elongate slot in one of the wall surfaces;

the insertion portion of the barrier being configured to be received in the slot in a deployed position of the barrier wherein the interception surface is arranged to intercept the water travelling downwardly through the cavity.

6. A system according to claim 5, wherein an injection tool is provided for injecting a water resistant composition into the slot to impede water flow around the insertion portion of the barrier, the injection tool being operable to inject said water resistant composition while travelling along the slot.

7. A system according to claim 5, wherein the barrier includes at least first and second elongate barrier portions, the first and second barrier portions being connected together along the length dimension of the barrier and moveable relative to one another to define at least a flattened configuration and an extended, deployed configuration; and the barrier is stored as a coil in the flattened configuration.

8. A system according to claim 7, wherein the first and second barrier portions are moveable relative to one another from the flattened configuration through the deployed configuration to an installation configuration, and are resiliently biased away from the installation configuration towards the flattened configuration; and a releasable restraint means is provided for releasably restraining the first and second barrier portions in the installation configuration.

9. A system according to claim 5, wherein at least one drain is provided for conveying water intercepted by the interception surface out of the cavity, and in the deployed position the barrier defines a channel extending along the length dimension of the barrier for conveying the intercepted water to the drain.

10. A system according to claim 5, wherein the barrier includes four elongate barrier portions extending outwardly from an elastomeric joint, a respective one of the barrier portions defining the insertion portion, the barrier portions being connected together by the joint along the length dimension of the barrier and moveable relative to one another to define at least a flattened configuration and an extended, deployed configuration;

and the barrier portions are arranged to define a cruciform arrangement in the deployed configuration.

11. A system according to claim 10, wherein the barrier portions comprise a pair of upper barrier portions and a pair of lower barrier portions;

the upper barrier portions defining the interception surface in the deployed position of the barrier;

the lower barrier portions being arranged below the upper barrier portions in the deployed position of the barrier;

and in the deployed position the lower barrier portions define apertures through which air or insulation material may pass from the cavity below the barrier into spaces between the upper and lower barrier portions.

* * * * *